US005096174A

United States Patent [19]

Nishihara

[11] Patent Number: 5,096,174

[45] Date of Patent: Mar. 17, 1992

[54] COMPOSITE TYPE FOLDING MACHINE

[75] Inventor: Kunisuke Nishihara, Kanagawa, Japan

[73] Assignee: Toshiba Kikai Kabushiki Kaisha, Tokyo, Japan

[21] Appl. No.: 530,588

[22] Filed: May 31, 1990

[30] Foreign Application Priority Data

May 31, 1989 [JP] Japan ..... 1-138363
May 28, 1990 [JP] Japan ..... 2-138961

[51] Int. Cl.[5] ..... B42C 1/00

[52] U.S. Cl. ..... 270/47; 270/49; 270/211

[58] Field of Search ..... 270/1.1, 4, 12, 13, 270/14, 15, 18, 19, 20, 21.1, 45-51

[56] References Cited

U.S. PATENT DOCUMENTS 2,164,370 7/1939 Zuckerman ..... 270/47

FOREIGN PATENT DOCUMENTS 1810294 10/1969 Fed. Rep. of Germany ..... 270/47
93771 7/1980 Japan ..... 270/47
62-70172 3/1987 Japan .
62-70173 3/1987 Japan .

*Primary Examiner*—Edward K. Look
*Assistant Examiner*—Therese M. Newholm
*Attorney, Agent, or Firm*—Cushman, Darby & Cushman

[57] ABSTRACT

A composite type folding machine which cuts printed paper into cut sheets and selects between a mode in which the cut sheets are discharged one by one as a non-collected or separate folded sheet alternately into two directions and a mode in which two collected folded sheets of different kinds are discharged into a single direction is disclosed.

Two gripping cylinder provided at the discharging side in this machine are disposed at different intervals compared with that of pin mechanisms comprised in a thrusting cylinder close to the gripping cylinders in which a rotary cam having cam portions to actuate each the pin mechanism with different modes is provided.

In consequence, the phase of the rotary cam over the thrusting cylinder is changed to thereby choose one of the modes.

4 Claims, 9 Drawing Sheets

COMPOSITE TYPE FOLDING MACHINE

BACKGROUND OF THE INVENTION

1. Field of the invention

The present invention relates to folding machines for rotary printing machines and more particularly to a composite type folding machine which discharges separately two kinds of sheets of paper, cut from paper on which two kinds of patterns are printed alternately and successively, in the form of a folded sheet or in the form of folded collected sheets for each pattern.

2. Description of the related art

FIG. 9 schematically illustrates a conventional general folding machine.

In FIG. 9, printed paper 102 on which two kinds of patterns A and B are printed alternately and successively is folded along a longitudinal line by a former 101. The folded paper 102 is inserted between a cutting cylinder 103 and a pin cylinder 104 and cut into pieces having a pattern A or B width by two cutting blades 103*a* provided in the cutting cylinder 103 so that the cut sheet 102A or 102B has a pattern A or B, respectively. The cut sheets 102A and 102B are sequentially supported one by one by two pins 104*a* provided on the pin cylinder 104 and delivered sequentially to three pins 105*b* provided on a thrusting cylinder 105.

The thrusting cylinder 105 has three folding blades each provided between two adjacent pins 105*b*. Provided adjacent to the thrusting cylinder 105 is a gripping cylinder 106 which has six gripping jaws 106*a* which alternately grip a cut sheet 102A or 102B.

A pin 105*b* which supports the cut sheet 102A or 102B at a timing in which the folding blade 105*a* of the thrusting cylinder 105 and the gripping jaw 106*a* of the gripping cylinder 106 coincide is retracted from that sheet and this sheet 102*a* or 102B is then delivered to the gripping jaw 106*a*. By this operation, the cut sheet 102A or 102B is folded transversely in two. The folded sheet is then gripped by the gripping jaw 106*a*, distributed sequentially to an upper gripping cylinder 107 or a lower pawl cylinder 108 and discharged.

The operation of the pin 105*b* of the thrusting cylinder 105 or the gripping pawl 106*a* of the gripping cylinder 106 in the folding machine of FIG. 9 is performed by a rotary cam (not shown) provided on each of the thrusting and griping cylinders 105 and 106.

When the cut sheets 102A and 102B are collected or superposed and folded by the conventional folding machine shown in FIG. 9, there are the following problems:

A rotary cam (not shown) provided in the gripping cylinder 106 comprises cam portions each capable of moving reciprocality toward its radial direction, so that it is required to shift respective cam portions as to be desired. And the even number of the gripping jaws 106*a* of the gripping cylinder 106 are required to be controlled alternately so as not to operate. Therefore, the switching operation between the discharge of the folded sheet of the pattern A or B in separate and the discharge of folded collected sheets of the different patterns A and B is troublesome.

Since the rotary cam is provided not only in the gripping cylinder 106 but also in the thrusting cylinder 105 in the conventional folding machine, harsh noise or the like will occur due to vibrations on a drive system for the rotary cam to project and retract the pin 105*b* but also the rotation of the thrusting cylinder 105 is not performed smoothly.

When one plate having different patterns A and B in both is to be attached onto a plate cylinder, the operator can wrongly attach the plate at unfavorable reverse position on the plate cylinder. In that case, the position where the folded sheet is to be discharged from the griping cylinder 106 toward the upper gripping cylinder 107 or toward the lower gripping cylinder 108 must be changed on the opposite side of the gripping cylinder 106. To this end, the actuating and non-actuating gripping jaws 106*a* must be rearranged reversely, which is a troublesome adjustment.

Published Unexamined Japanese Patent Application Sho 62-70172 discloses a folding machine which is intended to solve the troublesome selection between folded collected cut sheets and folded separate or non-collected cut sheets.

This folding machine includes a cutting cylinder having cutting blades, a thrusting cylinder disposed adjacent to the cutting cylinder and having retractable pins and folding blades disposed alternately at intervals along the periphery of the thrusting cylinder, and gripping cylinders disposed close to the thrusting cylinder and having gripping mechanisms (gripping jaws). It hooks printed paper at one end with a pin of the thrusting cylinder to wind the paper around the thrusting cylinder, cuts the paper with a cutting blade and folds the cut sheet with a folding blade of the thrusting cylinder into a gripping mechanism of the gripping cylinder. In the folding machine, the diameter of the thrusting cylinder is selected so as to be one and a half times that of the cutting cylinder, the number of pins and the number of folding blades of the thrusting cylinder are three each, two gripping cylinders are disposed at angular intervals of 120 degrees at which the folding blades are disposed. Two fixed cams, two rotary cams and one manually rotatable cam are provided at the side of the thrusting cylinder to project and retract pins and folding of the thrusting cylinder. These fixed and rotary cams blades can operate the folding blades located on the gripping cylinder sides each time the thrusting cylinder rotates through $\frac{2}{3}$ of a complete rotation to deliver the cut sheets into the gripping mechanism while folding the cut sheets and simultaneously retracting the two pins from the associated cut sheets folded by the folding blade. The manually rotatable cam is constructed such that it operates the two folding blades and the two pins of the thrusting cylinder to bring about a state in which a non-collected or separate folded sheet is obtained or a state in which collected or superposed folded sheets are obtained by actuating one of the two folding blades and one of the pins.

However, the folding machine of the Publication requires one fixed cam, one rotary cam and one manually rotatable cam; namely, three cams in total to operate the pins, and hence the mechanism is complicated.

In this folding machine, the two gripping cylinders are disposed at an angular intervals equal to that at which the folding blades are disposed, so that the folded sheets are delivered from the thrusting cylinder to the respective gripping cylinders at the same timing (interval). Therefore, the single fixed cam and the single rotary cam cannot select only any one of the two gripping cylinders and discharge the sheets to that cylinder. Therefore, a fixed cam is inevitably required to be provided in addition to the first-mentioned fixed cam and the rotary cam in order to select any one of the two gripping cylinders.

Published Unexamined Japanese Patent Application Sho 62-70173 discloses an invention described using the same embodiment as that in the Publication Sho 62-70172. Claims of the Application Sho 62-70173 discloses a folding machine which discharges non-collected or separate folded sheets simultaneously into two directions and which omits a description concerning the manually rotatable cam. Therefore, collected folded sheets cannot be produced according to the arrangement disclosed.

It is an object of the present invention to provide a simple-structured composite type folding machine which freely selects one of collected folded sheets and separate folded sheets without requiring any complicated adjusting operations.

SUMMARY OF THE INVENTION

In order to decrease the number of cams (three) in the conventional folding machine, the inventors hit upon the provision of a plurality of cams different in phase on the rotary cam. In this case, even if a plurality of sets of cam portions are solely provided on the rotary cam and the angular intervals between two gripping cylinders is kept so as to be the same interval between two adjacent folding blades in the above conventional type and the phase of the rotary cam relative to the thrusting cylinder is changed to select a position of a cam portion of the rotary cam cooperative with the fixed cam, a different operation mode shall not be attained, because a folded sheet cannot be discharged toward a desired one of the gripping cylinders since a change in the phase acts equally on both the gripping cylinders.

In the present invention, a plurality sets of cam portions different in phase are provided on the rotary cam. In addition, the angular spacing between the two gripping cylinders along the periphery of the thrusting cylinder is set so as to different from that between the pin mechanisms along the periphery of the thrusting cylinder.

Specifically, the present invention is a composite type folding machine which cuts printed paper on which two kinds of different patterns are alternately printed into cut sheets and selects between a non-collected folded sheet alternate-discharge mode in which the cut sheets are discharged one by one as a non-collected or separate folded sheet alternately in two directions and a collected folded sheet one-direction discharge mode in which two collected folded sheets of different kinds are discharged in a single direction, comprising: a rotatable thrusting cylinder having an odd number of paper end supporting pin mechanisms where the odd number is an integer equal to, or larger than, 3 and a like number of paper folding blade mechanisms disposed alternately at equal intervals along the periphery of the cylinder; a pair of gripping cylinders provided close to the thrusting cylinder, each gripping cylinder including a gripping mechanism associated with the alternate folding blade mechanisms of the thrusting cylinder for folding a cut sheet in two and receiving same; a rotary cam provided rotatably and concentrically with the thrusting cylinder and rotated at a speed different from that of the thrusting cylinder, and including cam portions for controlling the operation of the respective pin mechanisms of the thrusting cylinder at the timing at which the gripping mechanism is associated with a folding blade mechanism; a fixed cam provided in juxtaposition with the rotary cam, fixed to a fixture of the folding machine and including a pair of pin actuating fixed cam portions corresponding to the pair of gripping cylinders; and wherein the pair of gripping cylinders are provided at positions where the spacing between the pair of gripping cylinders differs from that between any two adjacent pin mechanisms provided on the thrusting cylinder, wherein the cam portions of the rotary cam include a non-collected sheet folding cam portion and a collected sheet folding cam portion different in phase and formed on a single member and wherein by changing the phase of the rotary cam relative to the thrusting cylinder, one of the non-collected and collected sheet folding cam portions is caused to cooperate with the cam portions of the fixed cam to actuate a pin mechanism to thereby provide either a non-collected or a collected sheet folding operation.

The printed paper on which the two kinds of patterns are alternately printed is cut by the cutting blades on the cutting cylinder into a sheet of the printed paper, which is then supported by a pin of the pin mechanism in the thrusting cylinder and rotated in the predetermined direction and delivered as a folded sheet to one or the other of the gripping cylinders.

In the delivery, the pin mechanism of the thrusting cylinder is actuated as the pin is retracted. Simultaneously, one of the folding blade mechanisms of the thrusting cylinder acts onto the gripping mechanism in the gripping cylinder to thereby fold the cut sheet along a transverse line and deliver the folded sheet. At this time, in the transverse folding operation for the two kinds of cut sheets, any one of a mode in which cut sheets are distributed for each pattern one by one to the two gripping cylinders and a mode in which two collected folded sheets are delivered to any particular one of the two gripping cylinders selected by the action of the rotary cam and the fixed cam.

In order to actuates a pin mechanism, when a cam follower or the like which operates the pin mechanism comes to and coincides with the position of the fixed cam portion comprising a recess or the like in the fixed cam, a pin-mechanism operating cam portion, comprising a recess or the like, of the cam portions on the rotary cam is further required to come to and coincide with the position of the fixed cam portion.

In this case, the interval between the fixed cam portions of the fixed cam is set so as to be equal to the interval between the two gripping cylinders. The interval is not equal to that between two adjacent pin mechanisms of the thrusting cylinder. Therefore, the two gripping cylinders do not operate at the same time as the folding blade mechanism of the thrusting cylinder, so that they deviate in operation timing in correspondence to the interval between the two gripping cylinders along the periphery of the thrusting cylinder.

The cam portions formed on the rotary cam include an actuating portion which actuates the pin mechanism and a non-actuating portion which does not actuate the pin mechanism. These cam portions are rotated with a constant speed different over the pin mechanism of the thrusting cylinder because the rotary cam rotates at a speed different from that of the thrusting cylinder. When one of the fixed cam portions and a pin mechanism coincide each other due to the speed difference, one of the operating cam portions of the rotary cam coincides with them at a constant timing to thereby provide delivery of a cut sheet from the folding blade mechanism to the gripping mechanism.

Therefore, if the operating cam portion provided on the rotary cam is formed at such a position that after the cam portion operates a pin mechanism for one of the gripping cylinders, it acts another pin mechanism on the other gripping cylinder, the cut sheets are delivered one by one to both the gripping cylinders at different predetermined timings. This is a non-collected separate folded sheet alternate discharge mode.

At this time, a deviation in operation timing between one and the other of the gripping cylinders is due to the deviation between the interval at which the gripping cylinders are provided along the thrusting cylinder and the interval at which the pin mechanisms are provided, as mentioned above.

If the respective pin mechanisms are actuated only at the position of one gripping cylinder by the operating cam portion, the discharge of the cut sheets does not occur at the other gripping cylinder. This cut sheet not discharged rotates intactly together with the thrusting cylinder, so that the next cut sheet is collected or superposed on the former cut sheet. These two collected or superposed cut sheets are folded together in two at the position of the one gripping cylinder and then discharged. This is a collected folded sheet one-direction discharge mode.

In this case, the reason why the cut sheet which has passed through the position of the other gripping cylinder at a first time is necessarily discharged at the other gripping cylinder at a second time is that an odd number of pin mechanisms are provided on the thrusting cylinder and that the gripping cylinders and the pin mechanisms are alternately associated with each other. For example, assuming that there are five pin mechanisms, they are associated with one gripping cylinder in the order of 1st-3rd-5th (at a first rotation) -2nd-4th- (at a second rotation) 1st-3rd-5th- . . . (at a third rotation), and the 2nd and 4th pin mechanisms which have passed by that gripping cylinder are associated with that gripping cylinder at the second rotation. The 1st, 3rd and 5th pin mechanisms which have passed at the second rotation are associated with that gripping cylinder at the third rotation.

Collected folded sheets may be discharged only at the position of the other gripping cylinder different from the one gripping cylinder. This is also the collected folded sheet one-direction discharge mode.

In each mode selection, a predetermined set of cam portions of the plurality of sets of cam portions formed on the rotary cam so as to differ in phase is selected by changing the phases between the rotary cam and the thrusting cylinder.

BRIEF DESCRIPTION OF THE DRAWINGS

FIGS. 1-8 show one embodiment of the present invention in which:

FIG. 1 is a partially cross-sectional side view schematically illustrating the entire structure of the embodiment;

FIG. 2 is a partially cross-sectional front view of a thrusting cylinder;

FIG. 3 is a cross-sectional view taken substantially along the line III—III of FIG. 2;

FIG. 4 is a view taken along the line IV—IV;

FIG. 5 is a cross-sectional side view of a cutting cylinder, a thrusting cylinder, a fixed cam and a rotary cam placed in positional relationship;

FIG. 6 is a view corresponding to FIG. 5 which shows a non-collected folded sheet alternate discharge to upper- and lower-gripping cylinder discharge mode;

FIG. 7 is a view corresponding to FIG. 5 which shows a collected folded sheet discharge to upper-gripping cylinder mode;

FIG. 8 is a view corresponding to FIG. 5 which shows a collected fold sheet discharge to lower-gripping cylinder mode.

DETAILED DESCRIPTION OF THE PREFERRED EMBODIMENT

One embodiment of the present invention will be described hereinafter with reference to the drawings.

Figure 1:
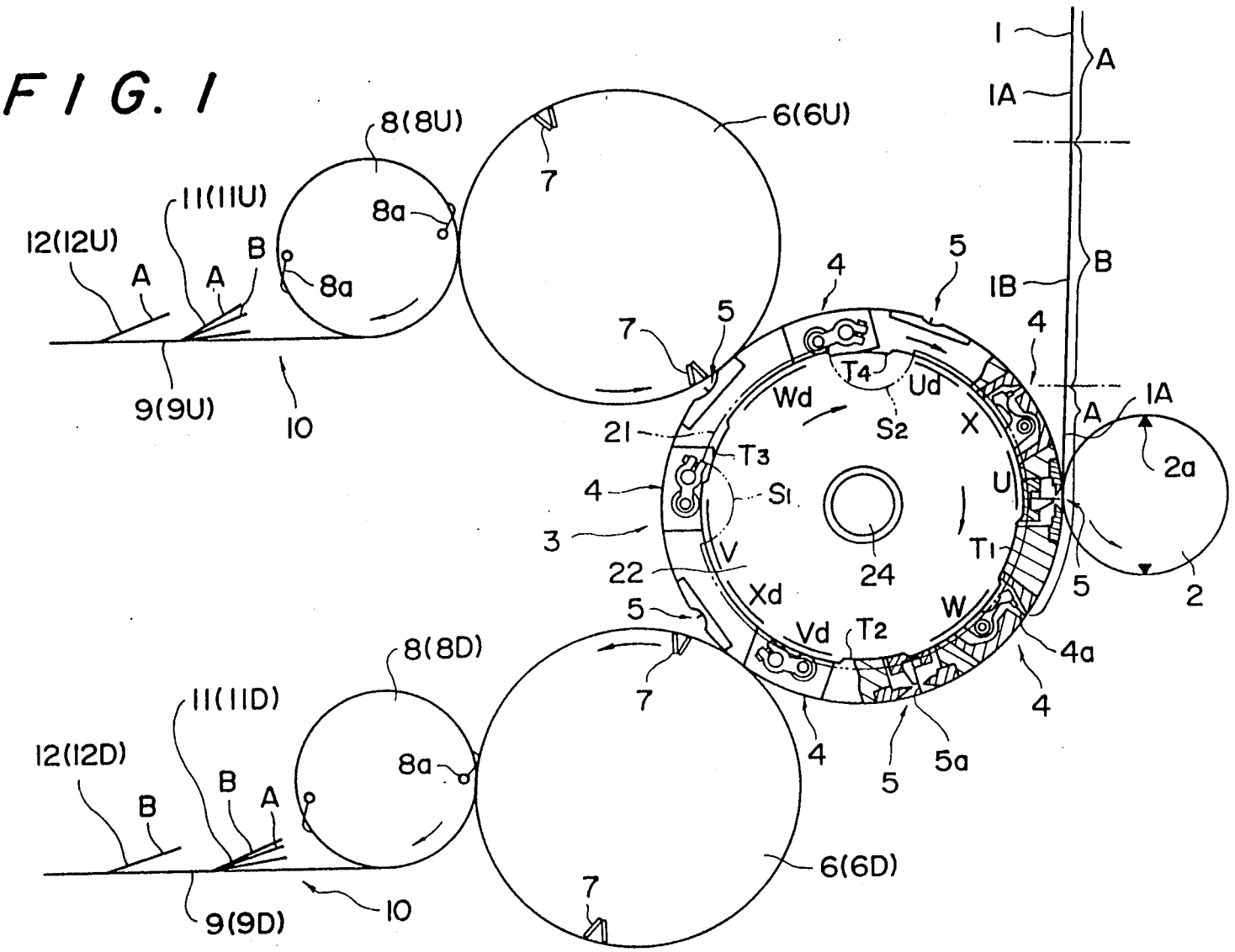

FIG. 1 is a schematic side view of a composite type folding machine of the embodiment. In FIG. 1, printed paper 1 is printed by a rotary printing machine including a double-plate cylinder having its diameter two times that of a general plate cylinder, (not shown). The printed paper 1 has two kinds of patterns A and B alternately printed thereon and is folded along a longitudinal line by a former (not shown) when required.

The printed paper 1 is fed toward a thrusting cylinder 3 which has a cutting cylinder 2 close thereto. The cylinders 3 and 2 are rotated at the same peripheral speed so as to roll substantially along each other's periphery.

The printed paper 1 is guided between the cutting cylinder 2 and the thrusting cylinder 3 and cut there. The cutting cylinder 2 has the same diameter as the plate cylinder and has a pair of cutting blades **2*a* disposed at equal intervals, namely at 180 degrees in the present embodiment, along the outer periphery of the cutting cylinder 2. Thus, the printed paper 1 having thereon the two kinds of patterns A and B printed by a corresponding plate (not shown) attached to the plate cylinder is cut into a cut sheet 1A or 1B having the pattern A or B by one complete rotation of the cutting cylinder 2**.

The thrusting cylinder 3 and the plate cylinder or the cutting cylinder 2 are selected so as to have a diameter ratio of n/2 where "n" is an odd number equal to, or larger than 3. In the present embodiment, "n" is selected so that n=5. Therefore, the thrusting and cutting cylinders have a diameter ratio of 5:2.

The periphery of the thrusting cylinder 3 is divided into "n" equal segments, namely 5 segments, in the particular embodiment. Disposed on each segment is a paper end support pin mechanism 4 and a paper folding blade mechanism 5. Therefore, the thrusting cylinder 3 has five pin mechanisms 4 and five folding blade mechanisms 5; namely, a total of 10 mechanisms which are disposed alternately at equal angular intervals of about 36 degrees. The angular intervals between any two adjacent pin mechanisms 4 and between any two adjacent folding blade mechanisms 5 is set to 72 degrees.

The reason why the word "about" is used for the angular interval between any two adjacent ones of the ten mechanisms is that the respective pin mechanism 4 and folding blade mechanism 5 are not necessarily required to be disposed at exactly the same angular interval.

Figure 2:
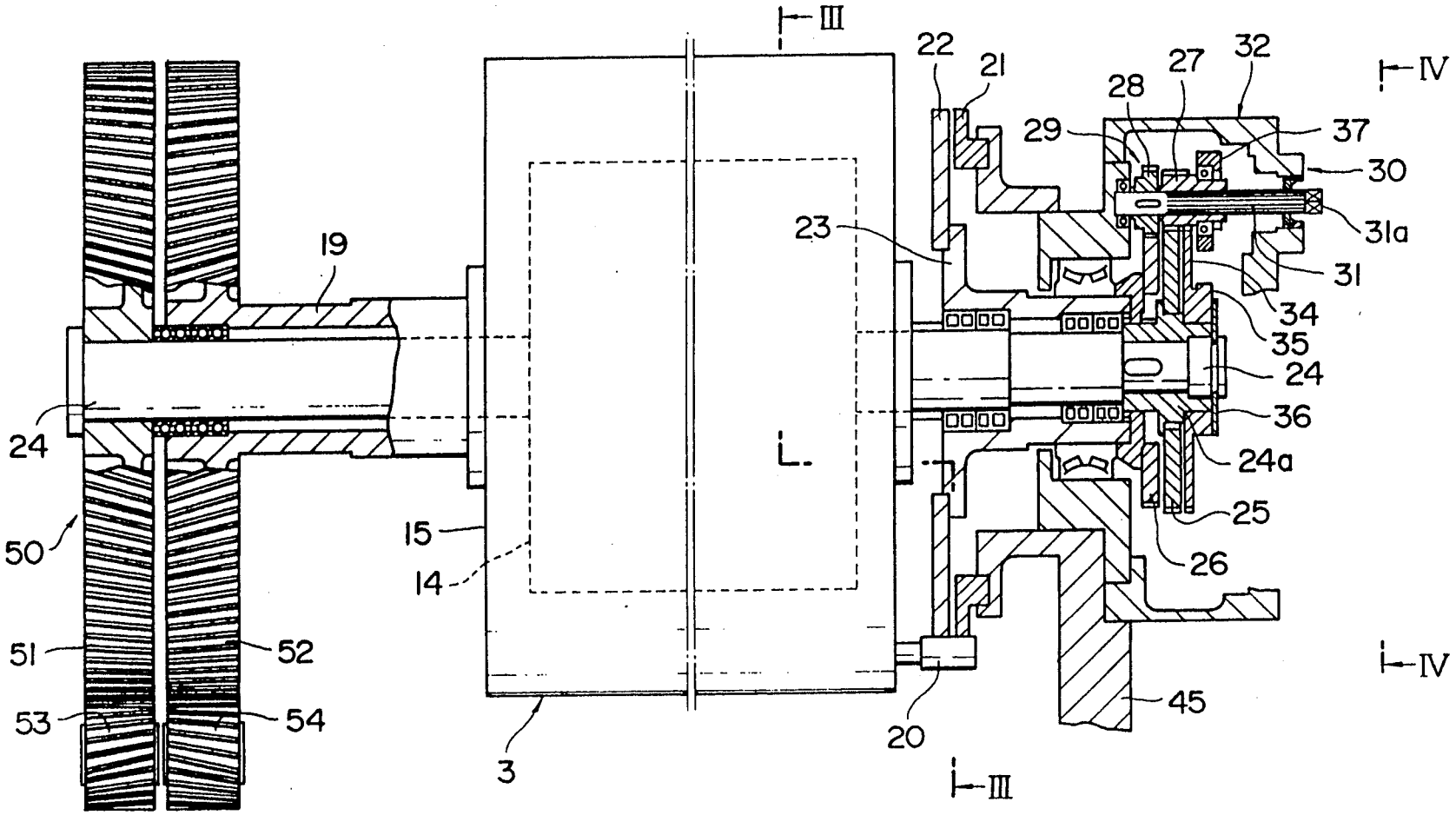
Figure 3:
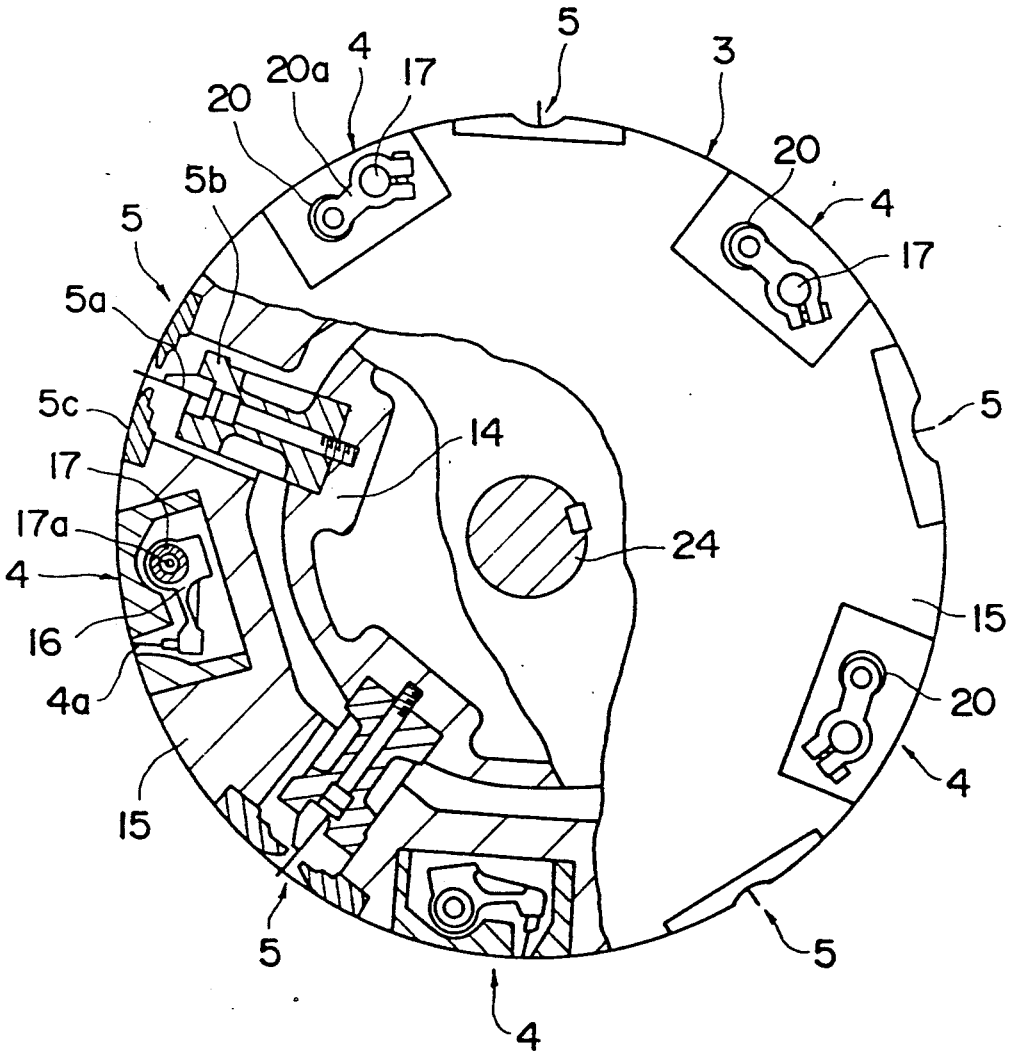

As shown in FIGS. 2 and 3, the thrusting cylinder 3 includes an inner cylinder 14 and an outer cylinder 15 disposed concentrically and fixed together to be rotatable. The inner cylinder 14 has a rotational shaft 24 fixed thereto, while the outer cylinder 15 has a hollow shaft 19 fixed thereto concentrically with the rotational shaft 24. The hollow shaft 19 is supported rotatably by the rotational shaft 24 and movable axially through a predetermined distance.

The rotation shaft 24 has at one end a larger-diameter helical gear 51 fixed thereto, while the hollow shaft 19 has at a similar end a helical gear 52 fixed thereto and having the same shape as the helical gear 51. The helical gears 51 and 52 mesh with driving helical gears 53 and 54, respectively. A gear chain 50 is constituted by the driving helical gears 53, 54 and the larger-diameter helical gears 51 and 52. The driving helical gears 53, 54 are connected to different drive sources (not shown) and driven at the same speed.

As shown in FIG. 3, each pin mechanism 4 includes a plurality of holders 16 each having a pin 4*a* attached to its end. The holders 16 are disposed at predetermined spacings on a rotational shaft 17 extending through the overall length of the outer cylinder 15. The rotational shaft 17 is rotatably supported by the outer cylinder 15 and has a lever 20*a* attached to its end protruding out of the outer cylinder 15. The lever 20*a* rotatably supports a roller-like cam follower 20 at its end.

The rotational shaft 17 is formed into a hollow shaft and has a torsion bar 17*a* extending therethrough. The torsion bar 17*a* is fixed at one end to the rotational shaft 17 and at the other end to the outer cylinder 15. By a twist force of the torsion bar 17*a*, the cam follower 20 fixed to the lever 20 is biased toward a cam side to be described later, namely, counterclockwise around the rotational shaft 17 in FIG. 3.

Therefore, the pins 4*a* attached through the holders 16 to the rotation shaft 17 are biased so as to enter into the thrusting cylinder 3 by the torsion bar 17*a*, while it is also biased so as to project outside of the thrusting cylinder 3 against the action of the torsion bar 17*a* due to the cam action. Such pin mechanism 4 is well known.

Each folding blade mechanism 5 includes a support base 5*b* fixed to the inner cylinder 14 and a thrusting folding blade 5*a* extruding its top end portion a little out of the outer cylinder 15.

A pair of guides 5C spaced a predetermined distance is provided in the vicinity of an top end of each thrusting folding blade 5*a* and fixed to the outer cylinder 15. The thrusting folding blade 5*a* and the guides 5C, namely, the inner and outer cylinders 14 and 15 are movable along the peripheral direction of the thrusting cylinder 5 within the spacing between the blade 5*a* and the guides 5C. Therefore, with one helical gear 54 of the drive side being fixed, when the larger-diameter helical gear 52 meshing with the helical gear 54 is moved along the shaft of the hollow shaft 19 by an actuator (not shown), the outer cylinder 15 deviates axially and circumferentially relative to the inner shaft 14 fixed to the rotational shaft 24. By this axial deviation, the respective pins 4*a* and cut sheets 1A or 1B can be adjusted in position, and the angular spacing between the pin 4*a* and the thrusting folding blade 5*a* can be adjusted according to the peripheral deviation.

In FIG. 1, two upper and lower gripping cylinders 6 are disposed at a predetermined angular interval and close to the thrusting cylinder 3. The thrusting cylinder 3 and the gripping cylinder 6 are driven at the same peripheral speed so as to roll substantially along each other's periphery.

Each gripping cylinder 6 has on its outer periphery a pair of gripping jaws 7 as a gripping mechanism at an angular distance of 180 degrees for reception of the corresponding folding blades. The gripping jaws 7 are opened and closed by a cam mechanism (not shown) provided in each gripping cylinder 6. The thrusting folding blade 5*a* provided on the thrusting cylinder 3 is engageable with the corresponding gripping jaw 7. The gripping jaw 7 and the corresponding folding blade mechanism 5 are engaged just synchronously with the rotation of the appropriate gripping cylinder 6 and the thrusting cylinder 3. The gripping jaw 7 is closed when that gripping jaw 7 and a thrusting folding blade 5*a* are engaged and receives a cut sheet 1A or 1B. Thus, substantially the center of a cut sheet 1A or 1B supported at its one end by the associated pin 4*a* is thrusted into the appropriate gripping jaw 7 by the thrusting blade 5*a* to be thereby folded in two and delivered as a folded sheet to the gripping cylinder 6.

The gripping cylinder 6 and the thrusting cylinder 3 have a diameter ratio of 4:5 and rotate at the same peripheral speed. Thus, while the gripping cylinder 6 makes a complete rotation, the thrusting cylinder 3 rotates through 4/5 of a complete rotation.

Therefore, four of the five folding blade mechanisms 5 provided on the thrusting cylinder 3 encounter the gripping cylinder 6 when same makes a complete rotation. Since the two gripping jaws 7 are provided in the gripping cylinder 6, both the gripping jaws 7 face alternate ones of the four folding blade mechanisms 5.

The distance along the periphery of the thrusting cylinder 3 between the upper and lower gripping cylinders 6, namely, between the positions where the respective gripping cylinder 6 contacts the thrusting cylinder 3 is set so as to be different from the distance between any two adjacent pin mechanisms 4 or any two adjacent folding blade mechanisms 5 along the periphery of the thrusting cylinder 3. More specifically, the distance, at which the upper and lower gripping cylinders 6 are disposed, along the periphery of the thrusting cylinder 3 is set so as to be 1.5 times (72 degrees $\times$ 1.5 = 108 degrees) the distance, at which any two adjacent pin mechanisms 4 or at which any two adjacent folding blade mechanism 5 are disposed, along the periphery of the thrusting cylinder 3.

Therefore, the position where the upper gripping cylinder 6 contacts the thrusting cylinder 3 when a gripping jaw 7 of the lower gripping cylinder 6 is engaged with a folding blade mechanism 5 is between the folding blade mechanism next to the folding blade mechanism 5 facing the lower gripping cylinder 6 and the next but one folding blade mechanism 5. Namely, the upper gripping cylinder 6 faces the pin mechanism 4 between those next and next but one folding blade mechanisms 5. In this case, the gripping jaw 7 of the upper gripping cylinder 6 is provided spaced a predetermined angle in a direction reverse to the direction of rotation of the gripping cylinder 6 from that contact position. Thus, the gripping jaw 7 provided on the upper gripping cylinder 6 is engaged with the respective alternate folding blade mechanisms 5 over which the gripping jaw 7 of the lower gripping cylinder 6 has skipped.

Provided close to the upper and lower gripping cylinders 6 are deceleration cylinders 8, respectively, which are driven at the same peripheral speed as the corresponding gripping cylinders so as to roll along each other's periphery. Each deceleration cylinder 8 has thereon a pair of grippers 8*a* provided at angular intervals of 180 degrees for receiving a folded sheet gripped by the gripping pawl 7.

Each deceleration cylinder 8 has a conveyer 9. Each deceleration cylinder 8 and the corresponding conveyer 9 constitute a folded sheet conveying device 10. Discharged onto the conveyer 9 are folded sheets 11 formed by transversely folding collected cut sheets 1A and 1B in accordance with the operational mode of the folding machine or a non-collected or separate folded sheet 12 formed by transversely folding each cut sheet 1A or 1B.

When the upper and lower gripping cylinders 6, deceleration cylinders 8 and conveyers 9 are to be described for the purpose of identifying whether they are the upper ones or the lower ones, reference numerals are used which are followed by the character U for denoting the upper one and by the character D for denoting the lower one.

In the right-hand half of FIG. 2, the thrusting cylinder 3 has a sleeve 23 provided rotatably on and concentrically with the rotational shaft 24. The sleeve 23 is supported rotatably by a frame 45 which comprises a fixture of the folding machine. The frame 45 has a fixed cam 21 fixed thereto, close to and concentric with the rotary cam 22. These rotary cam 22 and fixed cam 21 have a plurality of cam followers 20 disposed along and abutting on the peripheries of these cams under the action of the torsion bar 17*a* and coupled to the respective pin mechanisms 4.

Figure 5:
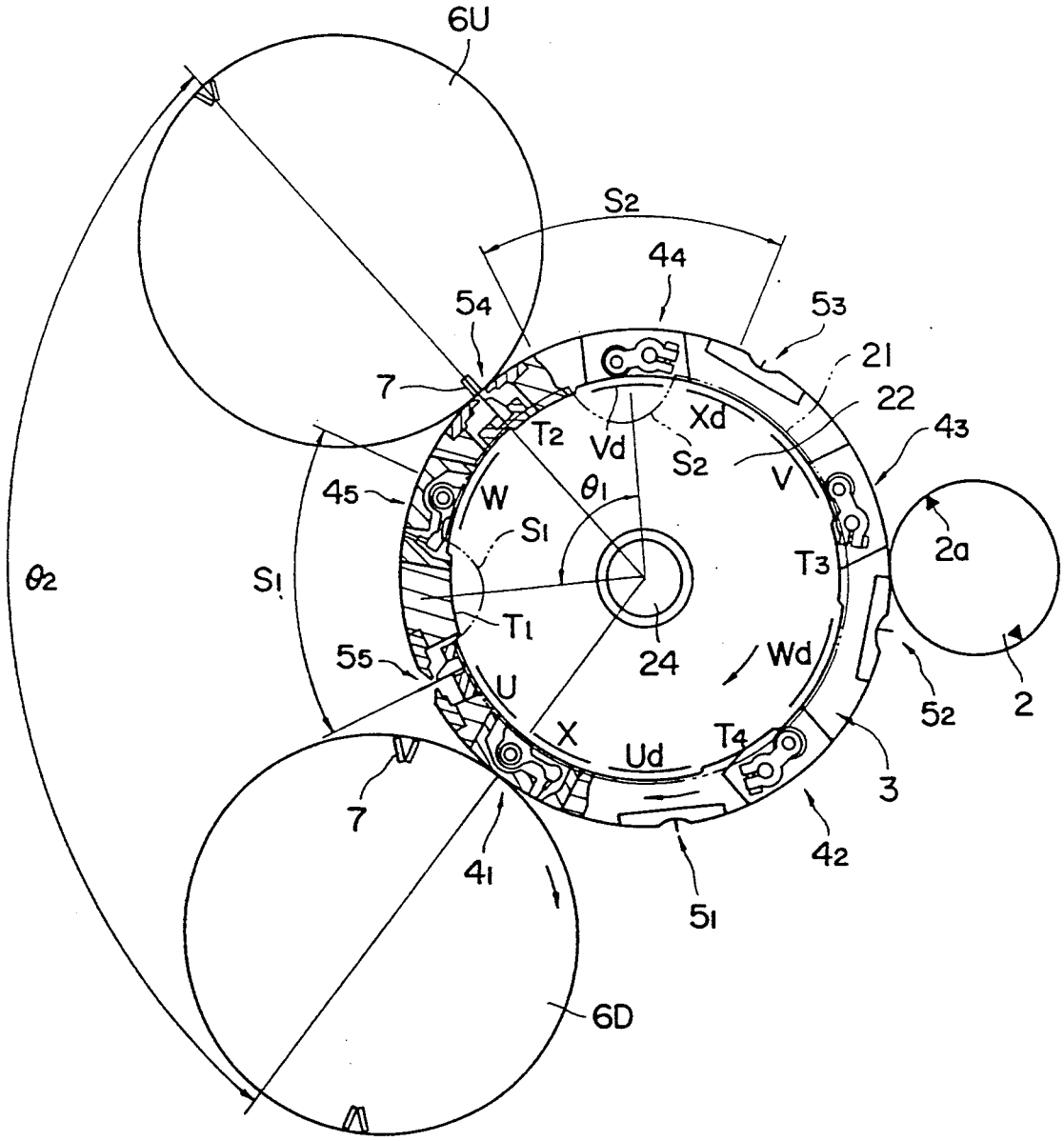

As shown in FIG. 5, the fixed cam 21 has a pair of recesses $S_1$ and $S_2$ as fixed cam portions for actuating the pins while the rotary cam 22 has four recesses $T_1$, $T_2$, $T_3$, $T_4$ as cam portions disposed in order clockwise for actuating the pins and eight non-actuation non-recess cam portions W, Vd, Xd, V, Wd, Ud, X and U disposed similarly clockwise, along the periphery of the rotary cam.

The recesses $S_1$ and $S_2$ are provided in the fixed cam 21 such that the central angle $\theta_1$ between those recesses for the rotational shaft 24 (see FIG. 5) is equal to the central angle $\theta_2$ between the two gripping cylinders 6 for the rotational shaft 24. When any one of the folding blade mechanisms 5 of the thrusting cylinder 3 faces the gripping jaw 7 of the lower gripping cylinder 6D, it is arranged that the lower recess $S_1$ faces the cam follower 20 of the pin mechanism 4 which holds the cut sheet 1A or 1B at the position of the appropriate folding blade mechanism 5. Therefore, when any of the folding blade mechanisms 5 of the thrusting cylinder 3 faces a gripping jaw 7 of the upper gripping cylinder 6U, the upper recesses $S_2$ faces the cam follower 20 of the pin mechanism 4 which holds the cut sheet 1A or 1B at the position of the appropriate folding blade mechanism 5.

The total of 12 cam portions comprising the recesses $T_1$, $T_2$, $T_3$, $T_4$ and non-actuating portions W, Vd, Xd, V, Wd, Ud, X, and U are provided at equal angles or at 30-degree spacings in the rotary cam 22.

More specifically, one non-actuating portion W is provided between the recesses $T_1$ and $T_2$; three non-actuating portions Ud, Xd and V are provided successively clockwise between the recesses $T_2$ and $T_3$; one non-actuating portion Wd is provided between the recesses $T_3$ and $T_4$; and three non-actuating portions Vd, X and U are provided successively clockwise between the recesses $T_4$ and $T_1$.

Therefore, the cam portions of the rotary cam 22 are disposed clockwise in the order of $T_1$, W, $T_2$, Vd, Xd, V, $T_3$, Wd, $T_4$, Ud, X and U.

Since the rotary cam 22 makes a 5/4 complete rotation per rotation of the thrusting cylinder 3, the rotary cam 22 makes a $\frac{1}{4}$ complete rotation while the thrusting cylinder 3 rotates through a distance equal to the distance between two adjacent pin mechanisms 4 of the thrusting cylinder 3, namely, while it makes a 1/5 complete rotation. This means that one-segment rotation of the a pin mechanism 4=a 1/5 complete rotation=72 degrees corresponds to a $\frac{1}{4}$ complete rotation of the rotary cam 22=90 degrees. Therefore, when the operation of the respective pin mechanisms 4 by the associated cam portions of the rotary cam 22 is considered, the shape of the cam portions of the rotary cam 22 located at angles of 90 degrees becomes an issue.

The cam portions formed at angular intervals of 90 degrees on the rotary cam 22 sequentially act on the respective pin mechanisms 4 rotated sequentially to fixed positions (corresponding to the fixed cam portions of the fixed cam 21). Since the four cam portions formed at the angular intervals of 90 degrees correspond to one complete rotation of the rotary cam 22, the same cam portions will be placed repeatedly at particular fixed positions synchronously with the movement of the pin mechanisms 4.

Therefore, four of the twelve cam portions disposed at angular spacings of 90 degrees constitute one group. More specifically, the cam portions $T_1$, Vd, $T_3$, Ud constitute one group; and the cam portions W, Xd, Wc and X constitute another group; the cam portions $T_2$, V, $T_4$, and U constitute a third group. The cam portions of these three groups correspond to different folded sheet discharge modes.

When any one of the recesses $T_1$, $T_2$, $T_3$, $T_4$ in the rotary cam 22 comes to and coincides with the recess $S_1$ or $S_2$ in the fixed cam 21 by the relative operation of the rotary and fixed cams 22 and 21 having such shapes, the cam follower 20 at the position where the coincidence occurs is operated counterclockwise in FIG. 5 around the rotational shaft 17 and the pin 4*a* of the pin mechanism 4 is retracted from the periphery of the thrusting cylinder 3. In FIGS. 1 and 5, the outer periphery of the fixed cam 21 shown by the dot-dot-dashed line is drawn larger than that of the rotary cam 22 in order to facilitate the understanding, but those cams 21 and 22 have the same diameter actually and have the cam followers 20 abutting on their peripheries. The illustrated shapes of the outer periphery of the cams 21 and 22 apply to other figures described below.

In FIG. 2, the rotational shaft 24 has at its right-hand end a first gear 25 through a hub 24*a* such that the first gear 25 rotates together with the shaft 24. The sleeve 23 rotatable around the rotational shaft 24 has a second gear 26 fixed thereto and smaller in diameter than the first gear 25. The first gear 25 meshes with a third gear 27 while the second gear 26 meshes with a fourth gear 28.

The third gear 27 is supported movable axially and non-rotatably by a spline or key to the shaft 31 while the fourth gear 28 is fixed to the shaft 31 by a key. The shaft 31 is supported rotatably in the frame 45 in parallel to the rotational shaft 2. The shaft 31 has a rectangular engaging end 31*a* extending from the frame 45 and engageable with a handle (not shown).

The hub 24*a* fixed to the rotational shaft 24 rotationally supports a rest plate 34 having the same gear shape as the first gear 25. The rest plate 34 meshes normally with the third gear 27. When the third gear 27 is moved rightward in FIG. 2 along the spline or the like in the shaft 31, the third gear 27 is disengaged from the first gear 25.

Figure 4:
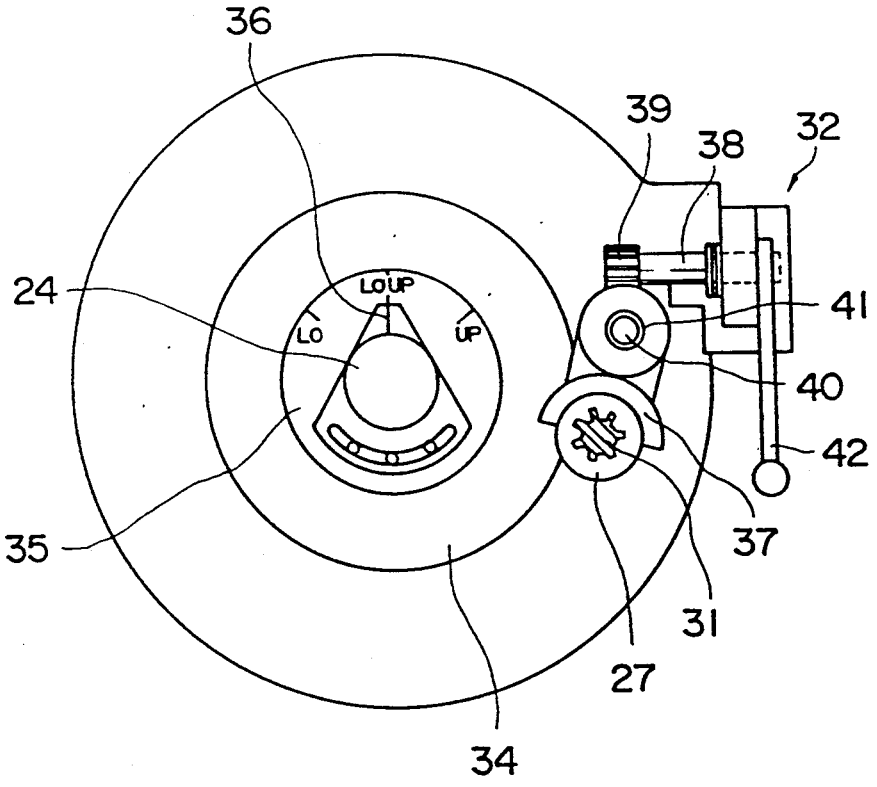

As shown in FIG. 4, the rest plate 34 has a scale plate 35 fixed to its outer surface and having scales such as L0, LO. UP and UP. The rotational shaft 24 has a pointer 36 fixed thereto and opposite to the scale plate 35 so as to allow to read the relative angle between the scale plate 35 or the rest plate 34 and the rotational shaft 24 or the first gear 25 fixed through the hub 24*a* to the rotational shaft 24, or the relative phase state during rotation.

The third gear 27 has an engaging member 37 attached rotatably thereto and non-movable axially. As shown in FIG. 4, the engaging member 37 has a rack 41 connected thereto and supported slidably by a guide bar 40 attached to the frame 45. The rack 41 meshes with a pinion 39 fixed to one end of the shaft 38 which is supported rotatably by the frame 45 and has a lever 42 attached to the other end thereof.

Therefore, by turning the lever 42, the rack 41 is moved forwardly and backwardly through the shaft 38 and the pinion 39 so that the third gear 27 is engaged with, or disengaged from, the first gear 25. At this time, the third gear 27 and the rest plate 34 are in mesh at all times in spite of the forward and backward movements of the rack 41.

A shaft mechanisms 32 for the third gear 27 includes the engaging member 37, rack 41, guide bar 40, pinion 39, shaft 38 and lever 42.

The rest plate 34 is rotated relative to the rotational shaft 24 to which the first gear 25 is fixed by rotating the shaft 30 using the handle (not shown) so that the phase angle between the pointer 36 and the scale plate 35 changes. The rotation of the third gear 27 is transmitted to the second gear 26 through the shaft 31 and fourth gear 28 and further to the rotary cam 22 through the sleeve 23.

Thus, when the shaft 31 is rotated, the engagement and hence phase between the first and second gears 25 and 26 change and the phase of the rotary cam 22 relative to the thrusting cylinder 3 also changes.

In the gear train 29 comprising the first gear 25, third gear 27, fourth gear 28 and second gear 26, the respective numbers of teeth of the gears are set such that an output speed is obtained which is 5/4 times the rotational speed of the first gear 25. Therefore, in this embodiment, the rotary cam 22 rotated together with the second gear 26 is rotated at a speed which is 5/4 times the rotational speed of the rotational shaft 24 to which the first gear 25 is fixed and the thrusting cylinder 3 rotated together with the rotational shaft 24. In consequent, the rotary cam 22 rotates through 5/4 of a complete rotation when the thrusting cylinder 3 makes a complete rotation, and precedes the thrusting cylinder 3 by ¼ of a complete rotation (90 degrees).

One example of specific specifications of the respective gears of the gear train 29 in the present embodiment is: z (the number of teeth)=100, m (module)=3.5 in the first gear 25; z=20, m=3.5 in the third gear; z=28, m=3 in the fourth gear; and z=112, m=3 in the second gear 26.

The operation of the present embodiment will be described.

Printed paper 1 on which two kinds of patterns A and B are printed alternately is cut by the cutting blade 2*a* of the cutting cylinder 2 into a cut sheet 1A or 1B. The cut sheet 1A or 1B is supported by the pins 4*a* of the pin mechanisms 4 of the thrusting cylinder 3, rotated clockwise and delivered to the upper gripping cylinder 6U or to the lower gripping cylinder 6D.

In this delivery, the pin mechanisms 4 of the thrusting cylinder 3 is actuated by the rotary cam 22 and the fixed cam 21, so that the pins 4*a* are retracted from the cut sheet 1A or 1B. Simultaneously, the thrusting folding blade 5*a* acts on the gripping jaw 7 of the gripping cylinder 6 to fold the cut sheet 1A or 1B transversely.

When the cut sheet is folded transversely, the cut sheet 1A or 1B is held by the pins 4*a* and the thrusting folding blade 3*a* acts on the gripping jaw 7, a non-collected or collected folded sheet 12 is formed. When two cut sheets 1A and 1B are held by the pins 4*a* and the thrusting folding blade 5*a* acts on the griping jaw 7, the collected folded sheets 11 are formed.

Whether a single cut sheet is held by the pins 4*a* or two cut sheets are is determined depending on whether both the upper and lower gripping cylinders 6U and 6D are operated simultaneously or whether only one of the gripping cylinders is. When both the gripping cylinders 6U and 6D are operated simultaneously to take out the cut sheets 1A and 1B alternately, a single cut sheet is held by the pins 4*a*. When only one of the gripping cylinders is operated so that the cut sheets are taken out from alternate ones of the five folding blade mechanisms of the thrusting cylinder 3, two cut sheets are held by the pins.

When the cut sheets are taken out one by one, the upper and lower gripping cylinders 6U and 6D take the cut sheet 1A or 1B from alternate folding blade mechanisms 5, so that the respective upper and lower gripping cylinders 6U and 6D take out a cut sheet 1A or 1B of the same pattern A or B at all times. For example, assuming that a cut sheet 1A is taken out by the upper gripping cylinder 6U, a cut sheet 1B is taken out by the lower gripping cylinder 6D.

When one of the upper and lower gripping cylinders 6U and 6D is operated, the cut sheet 1A or 1B which is not taken out in the non-actuating gripping cylinder 6D or 6U is rotated together with the thrusting cylinder 6. Therefore, a new cut sheet 1B or 1A is superposed on the old cut sheet 1A or 1B at a second rotation of the thrusting cylinder 3 and hence the two cut sheets are accumulated. At this time, since the odd number of folding blade mechanisms 5 are provided on the thrusting cylinder 3 and the gripping jaws 7 take out the cut sheets alternately from the thrusting folding blades 5, the cut sheet which is not taken out at the first rotation is taken out necessarily at the second rotation.

Therefore, two cut sheets are taken out at all times and three or more are not. The cut sheets 1A and 1B have the same collected or superposed state at all times. In other words, the inner or outer cut sheets have the same pattern at all times.

Assume that a cut sheet 1A of the pattern A is located at each of the first and third ones of the five folding blade mechanisms 5 and no cut sheet is placed at the second mechanism. Under such conditions, if a cut sheet 1B of the pattern B is superposed on the cut sheet 1A located at the first folding blade mechanism 5, a cut sheet 1A of the pattern A is located on the second idle folding blade mechanism 5. Thereafter, a cut sheet 1B is superposed on the cut sheet 1A located on the third mechanism 5. Therefore, in the particular embodiment the collected folded sheets include inner cut sheets 1A of the pattern A and outer cut sheets 1B of the pattern B at all times.

The two thus collected cut sheets 1A and 1B are received by the gripping cylinder 6 side while a single cut sheet 1A is rotated as it is and a cut sheet 1B is superposed on the sheet 1A at the next rotation and delivered to the gripping cylinder 6.

When the inner one of the collected folded sheets is desired to be of the pattern B, the folding blade mechanisms 5 are required to shift by one segment such that the cut sheet 1B is located as an inner one.

Therefore, in FIG. 1, if only the lower gripping cylinder 6D, for example, is operated, the collected folded sheets 11D in which the inner folded sheet is a cut sheet 1A of the pattern A can be taken out while if only the upper gripping cylinder 6U is operated, the collected folded sheets 11U in which the inner folded sheet is a cut sheet 1B of the pattern B can be taken out.

When the superposed state of the patterns is to be changed, one segment of the folding blade mechanisms 5 is not necessarily required to be shifted. One segment shift was described for the purpose of facilitating the understanding of the description of the collected folded sheets 11D and 11U in FIG. 1.

As just described above, the delivery of the cut sheet 1A or 1B to the gripping cylinder(s) 6 is performed in any one of the three modes, namely, (i) a mode in which the cut sheets 1A and 1B are distributed alternately one by one in two routes to the upper and lower gripping cylinders 6U and 6D (a non-collected folded sheet alternate discharge to upper-and lower-gripping cylinder mode), (ii) a mode in which cut sheets 1A and 1B are superposed and delivered to the lower gripping cylinder 6D alone (collected folded sheets discharged to lower-gripping cylinder discharge mode), and (iii) a mode in which cut sheet 1A and 1B are superposed and delivered to the upper gripping cylinder 6U alone (collected folded sheets discharged to upper-gripping cylinder mode).

The folded sheets delivered to one or the both of the upper and lower gripping cylinders 6U and 6D in any mode are received by the deceleration cylinder 8 through the holding pawl 8*a* and accumulated via the discharge conveyer 9.

Selection of a mode in which the cut sheets 1A and 1B are delivered to the gripping cylinder(s) 6 is performed by changing the phase of the rotary cam 22 relative to the thrusting cylinder 3, using the phase adjuster 30.

(i) The non-collected folded sheet alternate discharge to upper- and lower-gripping cylinder mode, (ii) the collected folded sheet discharge to upper-gripping cylinder mode, and (iii) the collected folded sheet discharge to lower-gripping cylinder mode will be described in more detail in conjunction with the fixed and rotary cams 21 and 22.

Figure 6:
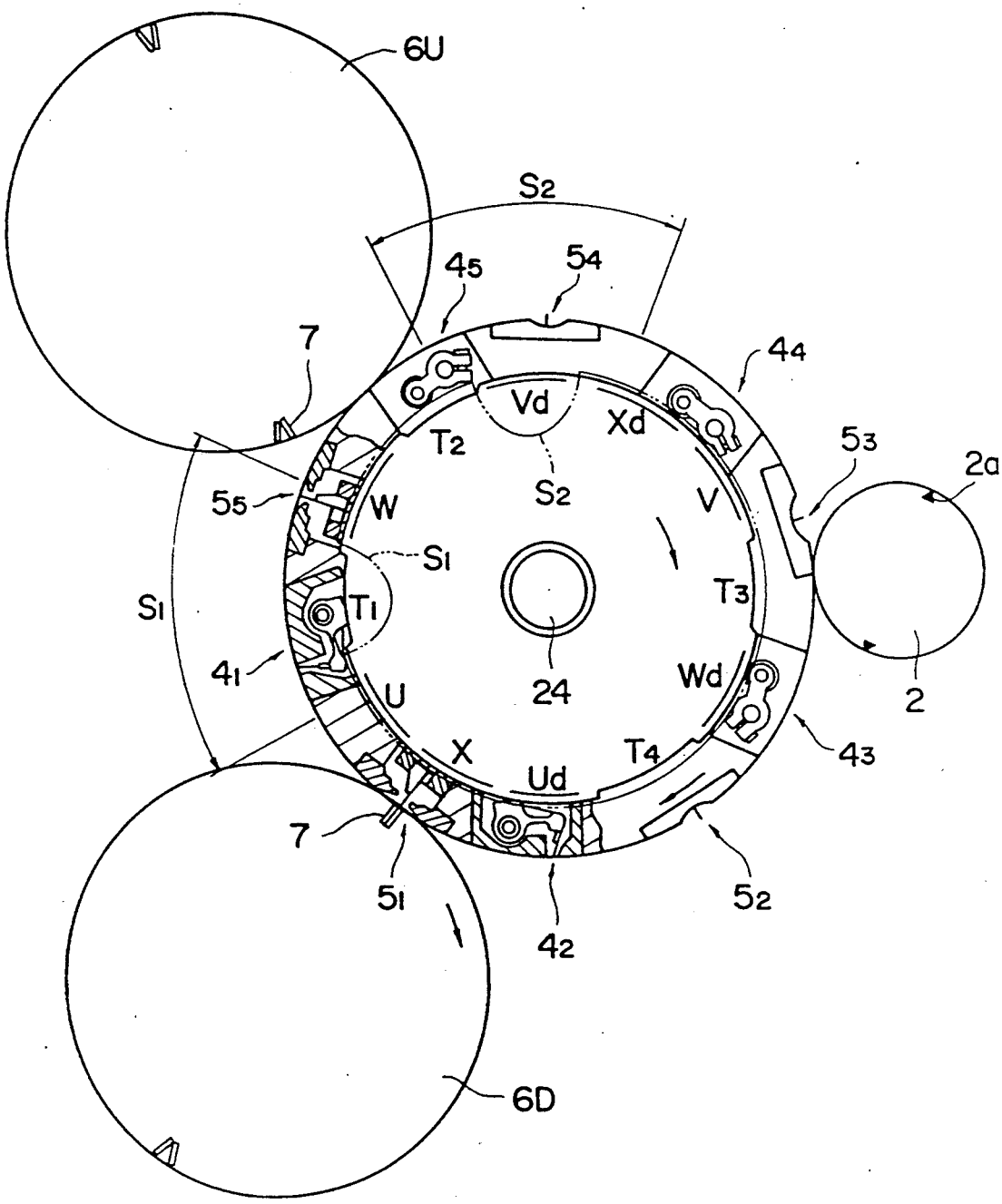

(i) Non-collected folded sheet alternate discharge to upper- and lower- gripping cylinder mode FIG. 6 shows the relationship between the thrusting cylinder 3, and fixed and rotary cams 21 and 22 and the relationship between cutting cylinder 2 and upper and lower gripping cylinders 6U and 6D in this particular mode. The phase angle of the thrusting cylinder 3 and the rotary cam 22 at this time is set by the phase adjuster 30.

The state set by the adjuster 30 is shown by the scale plate 35 and the pointer 36 shown in FIG. 4 where the pointer 36 is adjusted to the position of the scale LO.UP on the scale plate 35.

In FIG. 6, as the thrusting cylinder 3 rotates clockwise, the respective recesses $T_1$, $T_2$, $T_3$, $T_4$ and the respective non-actuating portions Vd, V, Ud, and U in the rotary cam 22 come sequentially to the positions of the recesses $S_1$, $S_2$ in the fixed cam 21 together with the pin mechanisms 4.

The rotational speed of the rotary cam 22 is at all times multiplied by a factor of 5/4 by the rotation of the thrusting cylinder 3 through the gear chain 29 comprising the first gear 25, the third, the fourth gears 27 and 28 and the second gear 26, and the relative phase angle between the rotary cam 22 and the thrusting cylinder 3 is changed by 90 degrees for each one complete rotation.

The five pin mechanisms 4 or the five cam followers 20 provided on the thrusting cylinder 3 are set at intervals of 72 degrees. Therefore, the rotary cam 22 rotates through 72 degrees $\times$ 5/4 = 90 degrees until the first cam follower 20 coincident with the recesses $S_1$ rotates clockwise through 72 degrees and the second cam follower 20 coincides with the recess $S_1$.

For convenience of description, the respective five pin mechanisms 4 and the associated folding blade mechanisms 5 are given corresponding subscripts 1–5 in FIG. 6. The pin mechanism 4 at the recess $S_1$ and the related folding blade mechanism 5 are given a subscript "1". Subscripts "2", "3", "4" and "5" are given to the pin mechanisms and the related folding blade mechanism 5 sequentially counterclockwise from the pin mechanism $4_1$ and the related folding blade mechanism $5_1$.

The movement of the recesses $S_1$ and $S_2$ will be described separately in the series of operations in order to avoid complication and the operations of both the recesses will last be related to each other.

First, the recess $S_1$ will be described. In FIG. 6, the cam follower 20 of the pin mechanism $4_1$ and the recess $T_1$ face the recess $S_1$. Therefore, the cam follower 20 is rotated counterclockwise by the action of the torsion bar 17*a* along the recess $T_1$, which causes the pins 4*a* to be retracted. Thus, the cut sheet 1B supported by the pins 4*a* is delivered to the gripping cylinder 6D by the folding blade mechanism $5_1$ and the gripping jaw 7 of the lower gripping cylinder 6D.

Thereafter, when the thrusting cylinder 3 is rotated clockwise through one segment for the pin mechanism 4 or through 72 degrees and the cam follower 20 of the pin mechanism $4_2$ comes to the position of the recess $S_1$, the rotary cam 22 is rotated clockwise through 90 degrees, so that the non-actuating portion Ud faces the recess $S_1$. Therefore, under such conditions, the cam follower 20 of the pin mechanism $4_2$ is not operated and the cut sheet 1A is not delivered by the folding blade mechanism $5_2$ to the gripping cylinder 6D.

When the thrusting cylinder 3 is further rotated through 72 degrees under such conditions, the recess $T_3$ in the rotary cam 22 faces the recess $S_1$. Therefore, the cam follower 20 of the pin mechanism $4_3$ is operated under such conditions and the cut sheet 1B is delivered by the folding blade mechanism $5_3$ to the gripping cylinder 6D.

Similarly, when the pin mechanism $4_4$ faces the recess $S_1$, the non-actuating portion Vd faces the recess $S_1$ and the cut sheet 1A is not delivered to the gripping cylinder 6D. Further, when the pin mechanism $4_5$ faces the recess $S_1$, the recess $T_1$ in the rotary cam 22 faces the recess $S_1$ and the cut sheet 1B is delivered to the gripping cylinder 6D.

Thereafter, when the thrusting cylinder 3 makes a complete rotation and the pin mechanism $4_1$ faces the recess $S_1$, the recess $S_1$ faces the non-actuating portion Ud, which is different from the initial state and the cut sheet 1A is not delivered to the gripping cylinder 6D because the rotary cam 22 has made a 5/4 complete rotation.

Thereafter, similar operations are repeated.

Any one of the cam followers 20 on the thrusting cylinder 3 is set so as to come to a position where the recess $S_1$ and $T_1$ or $T_3$ coincide with each other. Therefore, the cam follower 20 is moved into the recess $S_1$ and $T_1$ or $T_2$ by the action of the torsion bar 17*a* and the pins 4*a* are retracted from an end of the sheet 1B. At this time, the thrusting folding blade 5*a* and the gripping jaw 7 for transversely folding the cut sheet 1B from which the pins 4*a* are retracted are located at the position where the thrusting cylinder 3 contacts the lower gripping cylinder 6D, and the cut sheet 1B is changed to a folded sheet 12D, which is then received by the gripping cylinder 6D.

Since the gripping jaw 7 and the folding blade mechanism 5 are not located at the position where the upper gripping cylinder 6U contacts the thrusting cylinder 3 under the conditions of FIG. 6, the cam follower 20 of the pin mechanism 4 is not located at the position of the recess $S_2$.

Therefore, the cut sheets 1B are sequentially taken out as a non-collected or separate folded sheet 12D from the alternate pin mechanisms 4 to the lower gripping cylinder 6D in connection with the recess $S_1$.

The above relationships are summarized as shown in Table 1.

TABLE 1

| | | 1ST ROTATION | | | | 2ND ROTATION | | | |
|---|---|---|---|---|---|---|---|---|---|
| FIXED CAM RECESS | $S_1$ | $S_1$ | $S_1$ | $S_1$ | $S_1$ | $S_1$ | $S_1$ | $S_1$ | — |
| PIN MECHANISM | $4_1$ | $4_2$ | $4_3$ | $4_4$ | $4_5$ | $4_1$ | $4_2$ | $4_3$ | — |
| ROTARY CAM POSITION | $T_1$ | Ud | $T_3$ | Vd | $T_1$ | Ud | $T_3$ | Vd | — |
| (CUT) SHEET PATTERN | B | A | B | A | B | A | B | A | — |
| SHEET DELIVERY | Occur | Does not occur | Occur | Does not occur | Occur | Does not occur | Occur | Does not occur | — |

The recess $S_2$ will be described next. If the thrusting cylinder 3 is rotated through half of the angular distance (72 degrees/2) between two adjacent folding blade mechanisms 5, the cam follower 20 of the pin mechanism $4_5$ and the recess $T_2$ in the rotary cam 22 coincide with the recess $S_2$ in the fixed cam 21. In this case, the centers of the cam follower 20 and the recess $T_2$ are not necessarily required to coincide exactly with the center of the recess $S_2$ because there are no problems in the operation of the cam follower 20 since the recess $S_2$ and $T_2$ have predetermined widths.

By the coincidence of the recess $S_2$, the pin mechanism $4_5$ and the recess $T_2$, the cam follower 20 rotates into the recess $S_2$ and $T_2$ to retract the pins 4*a*, so that the cut sheet 1A can be delivered to the upper gripping cylinder 6U.

The coincidence of the recess $S_2$ and the pin mechanism $4_5$ occurs before the first rotation of the thrusting cylinder 3 starting from the pin mechanism $4_1$ in the description of the recess $S_2$. There are the inconveniences of the use of the pin mechanism $4_1$ located at the recess $S_2$ as the starting point for convenience of description, but there are no problems if this is considered as an occurrence in the course of the series of operations.

When the thrusting cylinder 3 rotates clockwise through one segment for the pin mechanism 4 or through 72 degrees and the pin mechanism $4_1$ comes to and coincides with the recess $S_1$ from the state where the pin mechanism $4_5$ coincide with the recess $S_2$, the non-actuating portion U of the rotary cam 22 coincides with the position of the recess $S_1$. Under such conditions, no cut sheet is delivered to the upper gripping cylinder 6U in which case the cut sheet 1B at the pin mechanism $4_1$ has been already delivered to the lower gripping cylinder 6D and the pin mechanism $4_1$ is idle at the position of the upper gripping cylinder 6U.

Similarly, when the thrusting cylinder 3 is rotated 72 degrees by 72 degrees and hence the pin mechanisms $4_2$, $4_3$, $4_4$, $4_5$ are moved sequentially to the position of the recess $S_2$, the recess $T_4$, the non-actuating portion V, the recess $T_2$, and the non-actuating portion U are sequentially located at the position corresponding to the recess $S_2$ in the rotary cam 22. In this case, when the recess $T_4$ and $T_2$ are located at the recess $S_2$, the pin mechanisms $4_2$ and $4_4$ are operated, so that the cut sheet 1A is delivered to the gripping cylinder 6U. The cut sheet 1A at these pin mechanisms $4_2$ and $4_4$ is the one left at the lower gripping cylinder 6D.

Therefore, the cut sheets 1A are sequentially taken out as a non-collected or separate folder sheet 12U from the alternate pin mechanisms 4 left at the lower gripping cylinder 6D to the upper gripping cylinder 6U associated with the recess $S_2$.

By the combination of the operations of both the recesses $S_1$ and $S_2$, the cut sheets 1B and 1A disposed alternately are taken out as separate folded sheets 12D and 12U from the lower and upper gripping cylinders 6D and 6U, respectively.

The relationship between the respective states in the recess $S_2$ will be summarized as shown in Table 2.

TABLE 2

| | — | 1ST ROTATION | | | | 2ND ROTATION | | | |
|---|---|---|---|---|---|---|---|---|---|
| FIXED CAM RECESS | ($S_2$) | $S_2$ | $S_2$ | $S_2$ | $S_2$ | $S_2$ | $S_2$ | $S_2$ | — |
| PIN MECHANISM | ($4_5$) | $4_1$ | $4_2$ | $4_3$ | $4_4$ | $4_5$ | $4_1$ | $4_2$ | — |
| ROTARY CAM POSITION | ($T_2$) | U | $T_4$ | V | $T_2$ | U | $T_4$ | V | — |

TABLE 2-continued

| | — | 1ST ROTATION | | | | | 2ND ROTATION | | |
|---|---|---|---|---|---|---|---|---|---|
| (CUT) SHEET PATTERN | (A) | B | A | B | A | B | A | B | — |
| SHEET DELIVERY | Occur | Does not occur | Occur | Does not occur | Occur | Does not occur | Occur | Does not occur | — |

Figure 7:
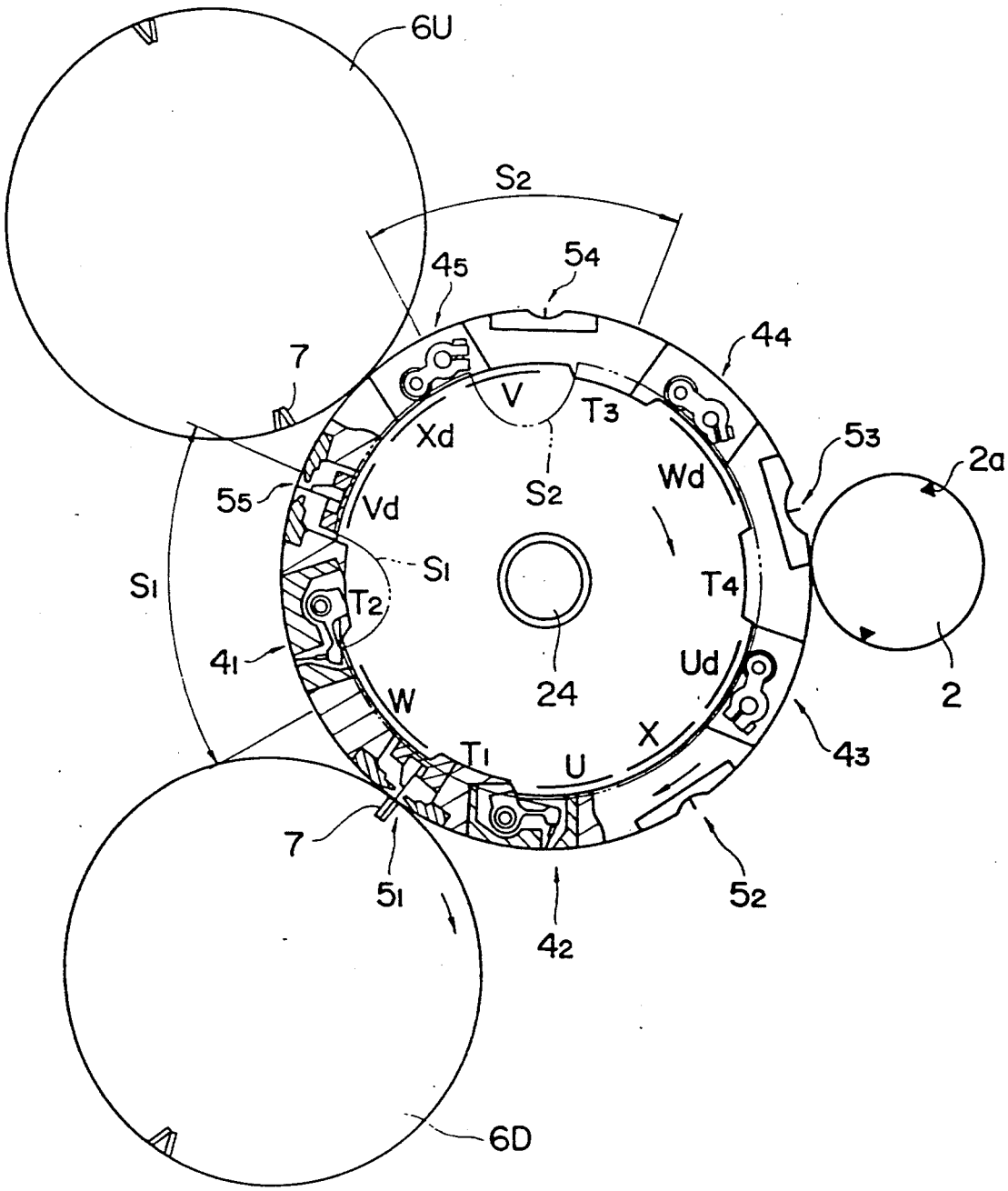

(ii) A mode in which collected folded sheets are discharged to lower-gripping cylinder FIG. 7 shows the relationship between the gripping cylinder 3, fixed cam 21 and rotary cam 22 and the relationship between the cutting cylinder 2, and upper and lower gripping cylinders 6U and 6D in this mode.

The pin mechanism 4 which takes the same position as the recesses $S_1$ and $S_2$ in the fixed cam 21 as the thrusting cylinder 3 rotates, the position of the rotary cam 22, the patterns of the inner and outer cut sheets and the presence/absence of the cut sheets delivered to the gripping cylinders 6 in FIG. 7 are collected as shown in Tables 3 and 4.

60 degrees form that in FIG. 6. A setting for shifting the rotary cam 22 to another phase is performed by the phase adjuster 30.

In this case, the lever 42 of the shift mechanism 32 is operated to disconnect the third gear 27 from the first gear 25 under which conditions a handle (not shown) is attached to the engaging end 31*a* of the shaft 31 to rotate the handle in the predetermined direction. Thus, the angle of the second gear 26 relative to the first gear 25 changes in which case setting is performed by watching the scale plate 35 and the pointer 36. More specifically, the pointer 36 is set so as to be adjusted to the scale plate 35 scale LO in FIG. 4.

When such adjustment of the phase angle is com-

TABLE 3

| | 1ST ROTATION | | | | | | 2ND ROTATION | | | | | 3RD ROTATION | | | |
|---|---|---|---|---|---|---|---|---|---|---|---|---|---|---|---|
| FIXED CAM RECESS | $S_1$ | $S_1$ | $S_1$ | $S_1$ | $S_1$ | $S_1$ | $S_1$ | $S_1$ | $S_1$ | $S_1$ | $S_1$ | $S_1$ | $S_1$ | — |
| PIN MECHANISM | $4_1$ | $4_2$ | $4_3$ | $4_4$ | $4_5$ | $4_1$ | $4_2$ | $4_3$ | $4_4$ | $4_5$ | $4_1$ | $4_2$ | $4_3$ | — |
| ROTARY CAM POSITION | $T_2$ | U | $T_4$ | V | $T_2$ | U | $T_4$ | V | $T_2$ | U | $T_4$ | V | $T_2$ | — |
| SHEET INNER PATTERN | (A) | A | (A) | A | (A) | A | A | A | A | A | A | A | A | — |
| SHEET OUTER PATTERN | B | — | B | — | B | — | B | — | B | — | B | — | B | — |
| SHEET DELIVERY | Occur | Does not occur | Occur | Does not occur | Occur | Does not occur | Occur | Does not occur | Occur | Does not occur | Occur | Does not occur | Occur | — |

TABLE 4

| | — | 1ST ROTATION | | | | | 2ND ROTATION | | | | | 3RD ROTATION | | | |
|---|---|---|---|---|---|---|---|---|---|---|---|---|---|---|---|
| FIXED CAM RECESS | ($S_2$) | $S_2$ | $S_2$ | $S_2$ | $S_2$ | $S_2$ | $S_2$ | $S_2$ | $S_2$ | $S_2$ | $S_2$ | $S_2$ | $S_2$ | $S_2$ | — |
| PIN MECHANISM | ($4_5$) | $4_1$ | $4_2$ | $4_3$ | $4_4$ | $4_5$ | $4_1$ | $4_2$ | $4_3$ | $4_4$ | $4_5$ | $4_1$ | $4_2$ | $4_3$ | — |
| ROTARY CAM POSITION | (Xd) | W | X | Wd | Xd | W | X | Wd | Xd | W | X | Wd | Xd | W | — |
| SHEET INNER PATTERN | (A) | — | A | — | A | — | A | — | A | — | A | — | A | — | — |
| SHEET OUTER PATTERN | (—) | — | — | — | — | — | — | — | — | — | — | — | — | — | — |
| SHEET DELIVERY | Does not occur | Does not occur | Does not occur | Does not occur | Does not occur | Does not occur | Does not occur | Does not occur | Does not occur | Does not occur | Does not occur | Does not occur | Does not occur | Does not occur | — |

The basic operations of the respective elements related to Tables 3 and 4 are similar to those in (i) the separate folded sheet alternate discharge mode, so that only the differences will be described.

The relative phase angle between the thrusting cylinder 3 and the rotary cam 22 in FIG. 7 is set at a position advanced clockwise 30 degrees from the relative phase angle in FIG. 6.

In this end, FIG. 7 shows the situation in which cut sheets are delivered to the lower-gripping cylinder such situation that FIG. 6 shows, due to favorable explanation, so that the rotary cam 22 is positioned as to be rotated counter-clockwise through one segment from that in FIG. 6 or through 90 degrees. Therefore, the rotary cam 22 advanced clockwise 30 degrees over the thrusting cylinder 3 is shown in FIG. 7 as to be reversed pleted, the lever 42 of the shift mechanism 32 is moved in the direction reverse to the direction in which the lever 42 was moved previously to thereby cause the third gear 27 to engage the first gear 25 to complete the setting of the phase angle.

The respective cam portions of the rotary cam 22 corresponding to the recess $S_1$ when the pin mechanisms $4_1$, $4_2$, $4_3$, $4_4$, and $4_5$ are moved sequentially at a first rotation to the position of the recess $S_1$ are the recess $T_2$, the non-actuating portion U, the recess $T_4$, the non-actuating portion V, and the recess $T_2$, in Table 3. In the original operation, cut sheets should naturally be delivered to the lower gripping cylinder 6D when the recess $T_2$ or $T_4$ coincides with the recess $S_1$.

However, at the first rotation, the cut sheet 1A of the pattern A which will be an inner cut sheet is not supported by the pin mechanism $4_1$, $4_8$ or $4_3$ at these positions. Therefore, these patterns are bracketed in Tables 3. Therefore, the cut sheets delivered to the gripping cylinder 6D are not collected folded ones, but only a cut sheet 1B at the positions of these pin mechanisms $4_1$, $4_3$ and $4_5$, so that these sheets are discarded or subjected to similar processing.

At the position where the recess $S_1$ and the non-actuating portion U or V coincide, the cut sheet 1A of the pattern A is supported intactly as an inner one of collected folded sheets by the pin mechanisms $4_2$ and $4_4$ at the appropriate positions and moved so as to start a second rotation without being discharged to the lower gripping cylinder 6D.

After the second rotation is started, the non-actuating portions U, V and U of the rotary cam 22 arrive at and coincide with the position of the pin mechanism $4_1$, $4_3$ or $4_5$ which coincides with the recess $S_1$. At this time, a cut sheet is discharged at the first rotation from each of the positions of the pin mechanism $4_1$, $4_3$ and $4_5$, so that the cut sheet is not supported at all by them. A cut sheet 1A of the pattern A is newly supported by the pin mechanism $4_1$, $4_3$ or $4_5$ at those positions and entered into a third rotation.

A cut sheet 1A of the pattern A is supported at the first rotation by the pin mechanisms $4_2$ or $4_4$ coincident with the recess $S_1$ and a cut sheet 1B of the pattern B is superposed on the cut sheet 1A at the second rotation. Since the recesses $T_4$, and $T_2$ in the rotary cam 22 coincide with those positions, cut sheets 1A and 1B are delivered to the gripping cylinder 6D and the two cut sheets 1A and 1B are delivered as collected folded ones 11D to the gripping cylinder 6D.

When in Table 4 the respective pin mechanism $4_1$, $4_2$, $4_3$, $4_4$ and $4_5$ coincide sequentially with the position of the recess $S_2$ at the first rotation, the portions of the rotary cam 22 coincident sequentially with that position are the non-actuating portions W, X, Wd, Xd, and W. Therefore, a cut sheet is not delivered at all to the upper gripping cylinder 6U and only passes by the lower gripping cylinder 6A to the cutting cylinder 2 side without any interaction. A cut sheet 1A of the pattern A is supported at the positions of the pin mechanisms $4_2$ and $4_4$ and no cut sheets are supported by other pin mechanism $4_1$, $4_3$ and $4_5$.

A cut sheet 1B of the pattern B is superposed on the cut sheet 1A at the pin mechanisms $4_2$ and $4_4$ at the second rotation, moved toward to the recesses $S_1$ side and discharged to the lower gripping cylinder 6D, as described in Table 3. A cut sheet 1A of the pattern A is supported in each of the pin mechanisms $4_1$, $4_3$, $4_5$ at the second rotation and transferred through the lower gripping cylinder 6D to the position of the recess $S_2$ at the second rotation.

The recesses $T_1$, $T_2$, $T_3$ and $T_4$ in the rotary cam 2 are not brought at all to the position of the recess $S_2$ simultaneously with the cam follower 20 of the pin mechanism 4 even at the second rotation. Therefore, no cut sheet is delivered to the upper gripping cylinder 6U. This apply at a third rotation and so on.

As described above, the delivery of the collected folded sheets 11D to the lower gripping cylinder 6D alone is performed at the timing of operation of the alternate ones of the fifth pin mechanisms 4 in this mode.

Figure 8:
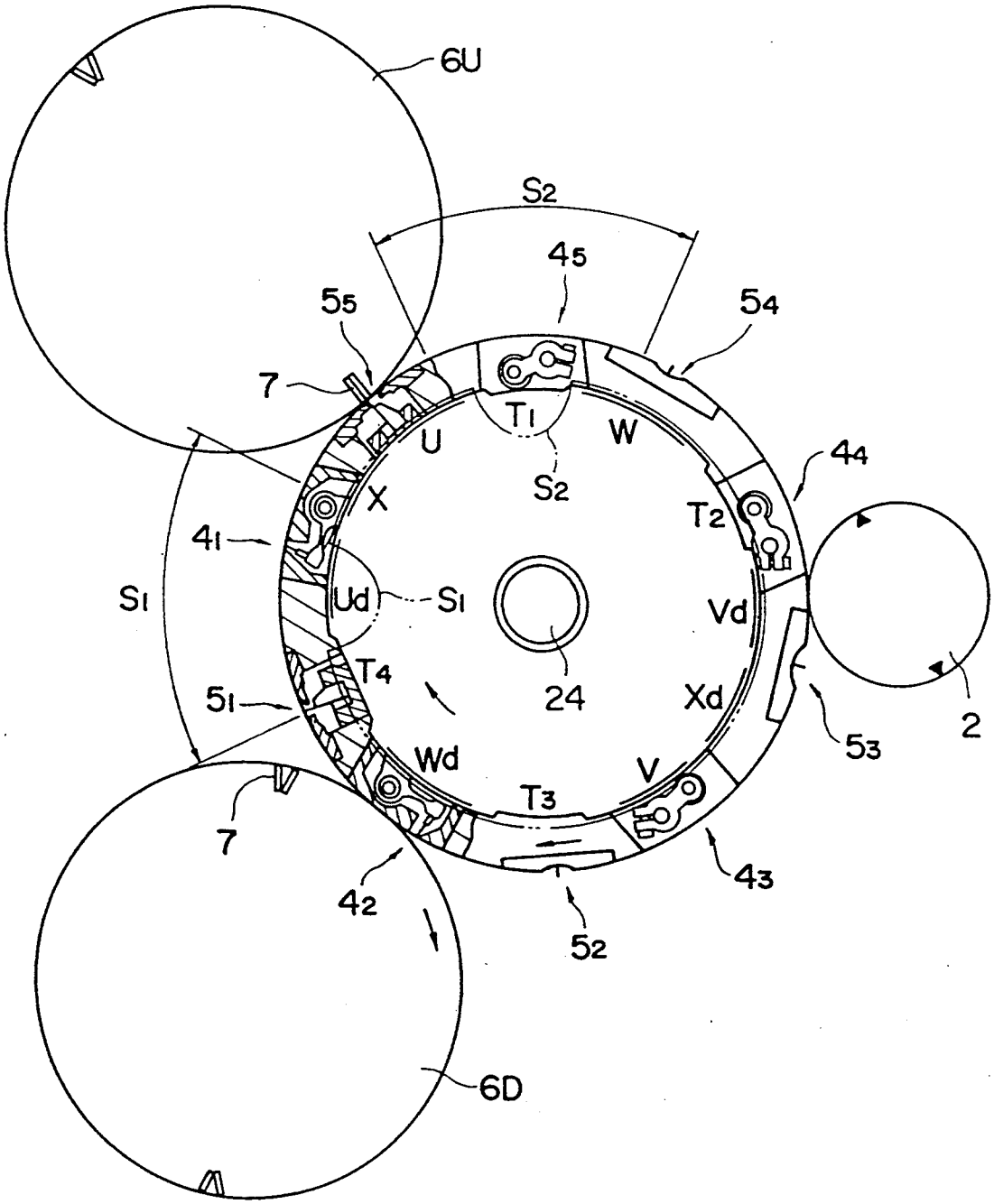
Figure 9:
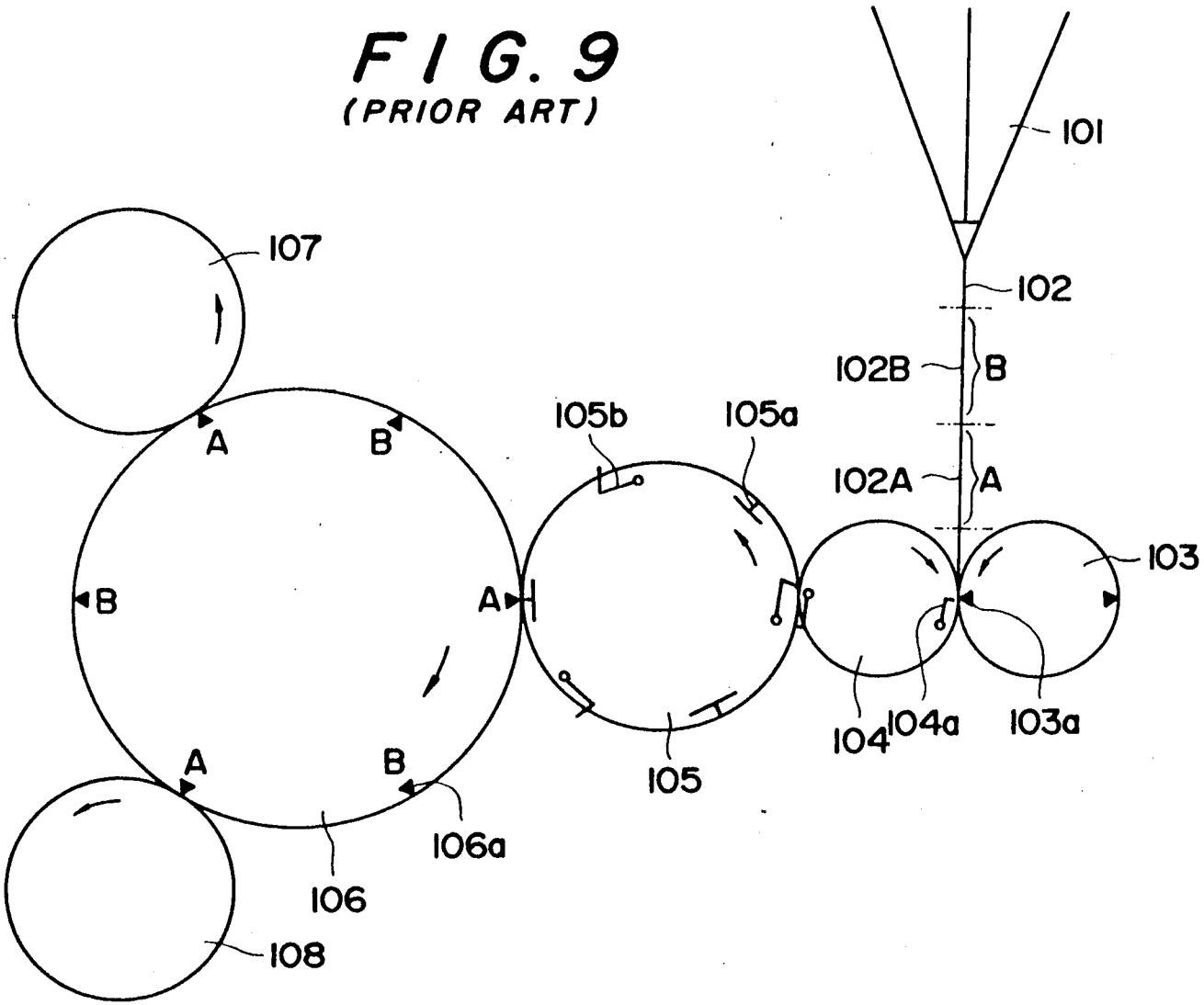
FIG. 9 (PRIOR ART)
FIG. 9 is a schematic side view of a conventional illustrative folding machine.

(iii) A mode in which collected folded sheets are discharged to upper-gripping cylinder FIG. 8 shows the relationship between the thrusting cylinder 3, the fixed cam 21 and the rotary cam 22, and the relationship between the cutting cylinder 2 and the upper and lower gripping cylinders 6U and 6D in this mode.

In FIG. 8, the pin mechanism 4 which will come to the same position as the recesses $S_1$, $S_2$ in the fixed cam 21 as the thrusting cylinder 3 rotates, the position of the rotary cam 22, the patterns of the inner and outer cut sheets and the presence/absence of the cut sheets delivered to the gripping cylinder 6 are collected as shown in Tables 5 and 6.

FIG. 8 shows the clockwise rotation of the pin mechanism $4_1$ through a predetermined angle after it has passed through the position of the recess $S_1$, unlike FIGS. 6 and 7. Thus, the mechanism $4_5$ coincides with the recess $S_2$ in the state shown. However, Table 5 shows the relationship between the respective elements at the position where the pin mechanism 4 coincides with the recess $S_1$.

TABLE 5

| | 1ST ROTATION | | | | | 2ND ROTATION | | | | | 3RD ROTATION | | | |
|---|---|---|---|---|---|---|---|---|---|---|---|---|---|---|
| FIXED CAM RECESS | $S_1$ | $S_1$ | $S_1$ | $S_1$ | $S_1$ | $S_1$ | $S_1$ | $S_1$ | $S_1$ | $S_1$ | $S_1$ | $S_1$ | $S_1$ | — |
| PIN MECHANISM | $4_1$ | $4_2$ | $4_3$ | $4_4$ | $4_5$ | $4_1$ | $4_2$ | $4_3$ | $4_4$ | $4_5$ | $4_1$ | $4_2$ | $4_3$ | — |
| ROTALY CAM POSITION | X | Wd | Xd | W | X | Wd | Xd | W | X | Wd | Xd | W | X | — |
| SHEET INNER PATTERN | B | (B) | B | (B) | B | B | B | B | B | B | B | B | B | — |
| SHEET OUTER PATTERN | — | A | — | A | — | A | — | A | — | A | — | A | — | — |
| SHEET DELIVERY | Does not occur | Does not occur | Does not occur | Does not occur | Does not occur | Does not occur | Does not occur | Does not occur | Does not occur | Does not occur | Does not occur | Does not occur | Does not occur | — |

TABLE 6

| | — | 1ST ROTATION | | | | | 2ND ROTATION | | | | | 3RD ROTATION | | | |
|---|---|---|---|---|---|---|---|---|---|---|---|---|---|---|---|
| FIXED CAM RECESS | ($S_2$) | $S_2$ | $S_2$ | $S_2$ | $S_2$ | $S_2$ | $S_2$ | $S_2$ | $S_2$ | $S_2$ | $S_2$ | $S_2$ | $S_2$ | $S_2$ | — |
| PIN MECHANISM | ($4_5$) | $4_1$ | $4_2$ | $4_3$ | $4_4$ | $4_5$ | $4_1$ | $4_2$ | $4_3$ | $4_4$ | $4_5$ | $4_1$ | $4_2$ | $4_3$ | — |
| ROTALY CAM POSITION | ($T_1$) | Ud | $T_3$ | Vd | $T_1$ | Ud | $T_3$ | Vd | $T_1$ | Ud | $T_3$ | Vd | $T_1$ | Ud | — |

TABLE 6-continued

| | — | 1ST ROTATION | | | | | 2ND ROTATION | | | | | 3RD ROTATION | | | |
|---|---|---|---|---|---|---|---|---|---|---|---|---|---|---|---|
| SHEET INNER PATTERN | (B) | B | (B) | B | (B) | B | B | B | B | B | B | B | B | B | — |
| SHEET OUTER PATTERN | (A) | — | A | — | A | — | A | — | A | — | A | — | A | — | — |
| SHEET DELIVERY | Occur | Does not occur | Occur | Does not occur | Occur | Does not occur | Occur | Does not occur | Occur | Does not occur | Occur | Does not occur | Occur | Does not occur | — |

The basic operations of the respective portions related to Tables 5 and 6 are similar to those in the (ii) mode in which collected folded sheets are discharged to the lower-gripping cylinder discharge mode except that the collected folded sheets are discharged to the upper gripping cylinder, so that the differences alone will be described.

The relative phase angle between the thrusting cylinder 3 and the rotary cam 22 in FIG. 8 is set at a position retarded 30 degrees counterclockwise from the relative phase angle in FIG. 6. Therefore, it is retarded 60 degrees counterclockwise compared to FIG. 7.

This setting is performed by the phase adjuster 30 in a manner similar to that mentioned above. In this case, whether setting is appropriate or not is determined by watching the scale plate 35 and the pointer 36. More specifically, setting is performed by adjusting the pointer 36 to the scale UP on the scale plate 35 of FIG. 4.

In Table 5, when the respective pin mechanisms $4_1$, $4_2$, $4_3$, $4_4$, and $4_5$ coincide sequentially with the position of recess $S_1$ at the first rotation, the positions of the rotary cam 22 coinciding sequentially with this position are the non-actuating portions X, Wd, Xd, W and X. Therefore, a cut sheet is not discharged at all to the lower gripping cylinder 6D, but moved as it is to the upper gripping cylinder 6U side. In this case, the inner one of the collected folded sheets is of the pattern B and the cut sheet 1B of the pattern B alone is supported by the pin mechanisms $4_1$, $4_3$, $4_5$ at the first rotation while the cut sheets 1B and 1A are supported superposed by the pin mechanisms $4_2$ and $4_4$. However, no inner cut sheets 1B are at the pin mechanisms $4_2$ and $4_1$ actually at the first rotation, so that the cut sheets 1B are shown bracketed.

The non-actuating portion Wd at the second rotation which is 90 degrees out of phase with that at the first rotation coincides with the pin mechanism $4_1$. The non-actuating portion Wd at a third rotation deviates similarly 90 degrees out of phase with that at the second rotation, and so on. However, in any event, no cut sheet is discharged to the lower gripping cylinder 6D.

In Table 6, the pin mechanism $4_5$ which is to coincide with the recess $S_2$ directly before the pin mechanism $4_1$ coincides with the recess $S_1$ is written in brackets in the lefthand column for the first rotation. When the pin mechanism $4_1$, $4_2$, $4_3$, $4_4$ and $4_5$ are moved sequentially to the position of the recess $S_2$, the cam portions of the rotary cam 22 coming to the recess $S_2$ are the non-actuating portions Ud, recess $T_3$, the inactive portion Vd, the recess $T_1$ and the non-actuating portion Ud. In this case, when the recess $T_3$ or $T_1$ coincides with the recess $S_2$, the cut sheet is delivered to the upper gripping cylinder 6U, which is the proper operation. However, no cut sheets 1B of the pattern B which will be an inner cut sheet are supported by the pin mechanism $4_2$ or $4_4$ at these positions at the first rotation, so that they are written bracketed in the Table. Therefore, the cut sheets placed at the positions of those pin mechanisms $4_2$ and $4_4$ and delivered to the gripping cylinder 6U are not collected folded ones, but only a separate cut sheet 1A, so that these sheets are discarded or subjected to similar processing.

The cut sheet 1B of the pattern B is supported intactly as an inner one of collected folded sheets by the pin mechanism $4_1$, $4_3$ or $4_5$ in a state where the non-actuating portion Ud or Vd coincides with the recess $S_1$ and entered into the second rotation without being discharged to the gripping cylinder 6U.

At the second rotation, the non-actuating portions Vd, Ud of the rotary cam 22 coincide sequentially with the pin mechanisms $4_2$ or $4_4$ coincident sequentially with the recess $S_2$. At this time, since the cut sheets have been discharged at the first rotation, no cut sheets are supported at the positions of the pin mechanisms $4_2$ and $4_4$. a new cut sheet 1B of the pattern B are supported by the pin mechanisms $4_2$, $4_4$ at those positions and entered into the third rotation.

A cut sheet 1B of the pattern B is supported by the pin mechanisms $4_1$, $4_3$, $4_5$ coincident with the recess $S_2$ at the first rotation and a cut sheet 1A of the pattern A is superposed on the cut sheet 1B at the second rotation. The recesses $T_3$, $T_1$, $T_3$ in the rotary cam 22 coincide sequentially with those positions of the pin mechanism so that the cut sheet is discharged to the gripping cylinder 6U and the two cut sheets 1B and 1A are delivered as collected folded ones 11U to the gripping cylinder 6U.

Similar operations are repeated at a third rotation and so on.

As mentioned above, the delivery of the collected folded sheets 11U to the upper gripping cylinder 6U alone is performed at the operation timing of the alternate ones of the fifth pin mechanisms in this mode.

According to the above embodiment, the following effects are produced.

The spacing along the periphery of the thrusting cylinder 6 between the two gripping cylinders 3 is set so as to be different from the spacing between two adjacent pin mechanisms 4 provided on the thrusting cylinder 3 and a plurality of cam portions which permit discharge of folded sheets in different modes are provided in the rotary cam 22. Therefore, only selection of one of the operation modes of the rotary cam 22 allows alternate discharging of non-collected folded sheets easily or discharging of the collected folded sheets. In addition, since only two cams, namely, the fixed cam 21 and the rotary cam 22, are required to be provided, so that the folding machine is simple in structure and easy to manufacture, inexpensive to provide and reduced in the number of malfunctions.

Selection of a folded sheet discharge mode is performed easily by the phase adjuster 30: namely, by removing a gear 27 in the gear train 29 provided between the rotary shaft 24 and the sleeve 23 which supports the rotary cam 22, using the shift mechanism 32, and rotating the shaft 31.

The alteration of the phase by the phase adjuster 30 can be observed by using the pointer 36 provided on the rotating shaft 24 and the scale plate 35 on the rest plate 34 attached rotatably on the rotary shaft 24, to thereby perform the phase alteration easily.

It is to be noted that the present invention is restricted to the respective embodiments and changes and modification falling within a scope in which the object of the present invention can be achieved should be included in the present invention.

For example, the number of pin mechanisms 4 and the number of folding blade mechanisms 5 provided on the thrusting cylinder 3 are not necessarily required to be 5. They may be 3 or 7 or a higher odd number.

The recesses $S_1$, $S_2$ in the fixed cam 21 and the recesses $T_1$–$T_4$ in the rotary cam 22 may take another form such as a convexity. Eventually, they may take any form so long as they can actuate the cam follower 20.

The recesses $S_2$, $S_1$ in the fixed cam 21 and the recesses $T_1$–$T_4$ in the rotary cam 22 may take another form such as a convexity. In summary they may have any form to actuate the cam follower 20.

In addition, the sets of cam portions provided on the rotary cam 22 for setting different folded sheets discharge modes are not necessarily required to be three in number, but may be two. In this case, one set of cam portions is used to provide a mode in which non-collected separate folded sheets are delivered alternatively to the gripping-cylinders and another set is used to provide a mode in which collected folded sheets are discharged to any particular one of the gripping cylinders. The plurality of cam portions provided in the rotary cam 22 are not necessarily required to be set so as to be different in phase at equal angles, but may be set freely to different values in view of interaction with other members possibly occurring in the operation. In this case, the phase adjuster 30 should have a function of adjusting the phase differences between a plurality of sets of cam portions in respective possible modifications, of course.

While in the illustrated embodiments the folding blade mechanisms 5 are shown as being provided fixed to the inner cylinder 14, they may be moved radially of the thrusting cylinder 3 at the same timing as the operation of the pin mechanisms 4.

While in the illustrated embodiments the rotary cam 22 is shown and described as being rotated through the gear train 29 by the rotational shaft 24 of the thrusting cylinder 3, the rotation of the rotary cam may be synchronized by a drive system completely different from the rotational shaft 24.

As mentioned above, according to the present invention, the spacing between the two gripping cylinders along the periphery of the thrusting cylinder is set so as to differ from that between two adjacent pin mechanisms along the periphery of the thrusting cylinder and cam portions for different modes are provided in the rotary cam so as to differ in phase, so that selection between the mode in which collected-folded sheets are discharged to only any particular gripping-cylinder and the mode in which non-collected folded sheets are discharged alternately to the two gripping-cylinder is easy. The inventive folding machine is simple in structure, easy to manufacture, and inexpensive to provide. In addition, few malfunctions occur.

While in the embodiment the diameter ratio among the cutting cylinder 2, the thrusting cylinder 3, the gripping cylinder 6 and the deceleration cylinder 8, rotating speed or the like is not necessary to be the same as the above embodiment and is able to be set at a different one at which each cylinder is rotated at the same peripheral speed so as to roll substantially along one another's periphery in order to deliver smoothly.

What is claimed is:

1. A composite type folding machine for cutting printed paper on which two kinds of different patterns are alternately printed into cut sheets and for selecting between a mode in which the cut sheets are discharged one by one alternately in two directions as a non-collected or separate folded sheet and a mode in which two collected folded sheets of different kinds are discharged in a single direction, the folding machine comprising:

a rotatable thrusting cylinder having an odd number of paper end supporting pin mechanisms, the odd number being an integer being one of equal to and larger than 3, and a like number of paper folding blade mechanisms, the paper end supporting pin mechanisms and the paper folding blade mechanisms being disposed alternately at equal intervals along the periphery of the thrusting cylinder, the thrusting cylinder being rotated at a first speed;

a pair of gripping cylinders disposed proximate to said thrusting cylinder, each gripping cylinder comprising at least one gripping mechanism which cooperates with the paper folding blade mechanisms of said thrusting cylinder to fold and receive one of the cut sheets, the pair of gripping cylinders being disposed at positions wherein a distance about the circumference of the thrusting cylinder between the pair of gripping cylinders differs from the spacing about the circumference of the thrusting cylinder between any two adjacent paper end supporting pin mechanisms provided on the trusting cylinder;

a rotary cam, disposed rotatably and concentrically with the trusting cylinder, for being rotated at a second speed different from the first speed of the trusting cylinder, and including cam portions for controlling operation of the paper end supporting pin mechanisms of the thrusting cylinder to be synchronous with a time at which the gripping mechanism cooperates with one of the paper folding blade mechanisms; and a fixed cam, provided in juxtaposition with the rotary cam and fixed to the folding machine, the fixed cam including a pair of pin actuating fixed cam portions for cooperating with the pair of gripping cylinders; and wherein the cam portions of the rotary cam include non-collected sheet folding cam portions and collected sheet folding cam portions, the non-collected sheet folding cam portions and the collected sheet folding cam portions being formed on a single member of the rotary cam at predetermined positions about the circumference of the rotary cam and wherein by shifting a rotational phase of the rotary cam relative to a second rotational phase of the thrusting cylinder, one of the non-collected and collected sheet folding cam portions cooperates with the pin actuating fixed cam portions of the fixed cam to actuate a pin mechanism to cause one of a non-collected and a collected sheet folding operation.

2. A composite type folding machine according to claim 1, wherein the collected sheet folding cam portions select one of two operation modes by changing a third rotational phase of the collected sheet folding cam portions to select one of the two gripping cylinders such that collected folded sheets are discharged to the selected cylinder.

3. A composite type folding machine for cutting printed paper on which two kinds of different patterns are alternately printed into cut sheets and for selecting between a mode in which the cut sheets are discharged one by one alternately in two directions as a non-collected or separate folded sheet and a mode in which two collected folded sheets of different kinds are discharged in a single direction, the folding machine comprising:

a rotatable thrusting cylinder including n pairs of paper end supporting pin mechanisms and paper folding blade mechanisms, each of the pairs being disposed at one of n corresponding equal segmental regions about the circumference of the thrusting cylinder such that each of the paper end supporting pin mechanisms and each of the paper folding blade mechanisms are disposed alternately, n being an odd integer being one of equal to and larger than 3;

a cutting cylinder disposed proximate to the thrusting cylinder and having means for cutting the printed paper into the cut sheets, each of the cut sheets having one of the patterns printed thereon;

a pair of gripping cylinders disposed proximate to the thrusting cylinder, each gripping cylinder including a plurality of gripping mechanisms, each of the mechanisms being able to hold a cut sheet thrust by one of the paper folding blade mechanisms of the thrusting cylinder, the diameter and rotational speed of each gripping cylinder and a number of gripping mechanisms being disposed on each of the cylinders are predetermined such that the gripping mechanisms cooperate sequentially with the paper folding blade mechanisms, a distance about the circumference of the thrusting cylinder between the pair of gripping cylinders differs from the spacing about the circumference of the thrusting cylinder between any two adjacent pin mechanisms provided on the thrusting cylinder;

a rotary cam, disposed rotatably and concentrically with the thrusting cylinder, for being rotated at a second speed different from the first speed of the thrusting cylinder, and including cam portions for controlling the operation of of the paper end supporting pin mechanisms of the thrusting cylinder to be synchronous with a time at which one of the paper folding blade mechanisms cooperates with the gripping mechanism, the cam portions including non-collected sheet folding cam portions and collected sheet folding cam portions both being formed on a single member of the rotary cam at different positions along the circumference of the rotary cam;

a fixed cam, provided in juxtaposition with the rotary cam, and fixed to the folding machine, the fixed cam including a pair of pin actuating fixed cam portions, disposed along the circumference of the fixed cam, for cooperating with the gripping cylinders;

a plurality of cam followers, disposed on the thrusting cylinder, for actuating the paper end supporting pin mechanisms by selectably engaging the cam portions of the rotary cam and the cam portions of the fixed cam; and a phase adjuster for changing a rotational phase of the rotary cam relative to a rotation of the thrusting cylinder such that one of one of the non-collected sheet folding cam portions and one of the collected sheet folding cam portions cooperates with one of the cam followers.

4. A composite type folding machine for cutting printed paper on which two kinds of different patterns are alternately printed into cut sheets and for selecting between a mode in which the cut sheets are discharged one by one alternately in two directions as a non-collected or separate folded sheet and a mode in which two collected folded sheets of different kinds are discharged in a single direction, the folding machine comprising:

a rotatable thrusting cylinder including five pairs of paper end supporting pin mechanisms and paper folding blade mechanisms, the paper end supporting pin mechanisms and the paper folding blade mechanisms being disposed alternately at equal intervals along the periphery of the cylinder;

a cutting cylinder disposed proximate to the thrusting cylinder and having means for cutting the printed paper into the cut sheets, each of the cut sheets having one of the patterns printed thereon;

a pair of gripping cylinders disposed proximate to the thrusting cylinder, each gripping cylinder comprising a plurality of gripping mechanisms, each of said gripping mechanisms being able to hold one of the cut sheets thrusted by one of the paper folding blade mechanisms of the thrusting cylinder, the diameter and rotational speed of each gripping cylinder and a number of gripping mechanisms being disposed on each of the cylinders are predetermined such that the gripping mechanisms cooperate sequentially with the paper folding blade mechanisms, a distance about the circumference of the thrusting cylinder between the pair of gripping cylinders differs from the spacing about the circumference of the thrusting cylinder between two adjacent paper end supporting pin mechanisms provided on the thrusting cylinder;

a rotary cam, disposed rotatably and concentrically with the thrusting cylinder, and comprising three sets having four cam portions, each set being disposed on the rotary cam at angular intervals of 90 degrees and each of the four cam portions of each of the three sets being separated by a predetermined angle, each of the three sets being able to control operation of each of the paper end supporting pin mechanisms of the thrusting cylinder at a time during which one of the paper folding blade mechanisms cooperates with one of the gripping mechanism, each of the cam portions being one of the following:

a non-collected sheet folding cam portion, a first superposed sheet folding cam portion having a first sheet discharge direction, and a second superposed sheet folding cam portion having a second sheet discharge direction, the second sheet discharge direction being different from the first sheet discharge direction;

a fixed cam, provided in juxtaposition with the rotary cam and fixed to the folding machine, the fixed cam including a pair of pin actuating fixed cam portions corresponding to the pair of gripping cylinders;

a plurality of cam followers, disposed on the thrusting cylinder, for actuating the paper end supporting pin mechanisms by selectably engaging the cam portions of the rotary cam and the cam portions of the fixed cam;

a gear train, comprising a plurality of gears, for amplifying the rotational speed of the thrusting cylinder by a factor of 5/4 and transmitting the resulting rotational speed to the rotary cam; and a phase adjuster for changing engagement of the gears to change a rotational phase of the rotary cam relative to a rotation of the thrusting cylinder such that one of one of the non-collected sheet folding cam portions and one of the collected sheet folding cam portions cooperates with one of the cam followers.

* * * * *